US009320405B2

(12) United States Patent
Luedke et al.

(10) Patent No.: US 9,320,405 B2
(45) Date of Patent: Apr. 26, 2016

(54) SURFACE CLEANING APPARATUS

(71) Applicant: BISSELL Homecare, Inc., Grand Rapids, MI (US)

(72) Inventors: Adam Luedke, Holland, MI (US); Kan Yuk Yiu, Hong Kong (CN); Jian Yun Pi, Jiangxi Province (CN); Joseph P. Perry, Cornstock Park, MI (US); Jian Gang Fan, ShenZhen (CN)

(73) Assignee: BISSELL Homecare, Inc., Grand Rapids, MI (US)

( * ) Notice: Subject to any disclaimer, the term of this patent is extended or adjusted under 35 U.S.C. 154(b) by 517 days.

(21) Appl. No.: 13/788,957

(22) Filed: Mar. 7, 2013

(65) Prior Publication Data

US 2013/0232713 A1 Sep. 12, 2013

Related U.S. Application Data

(60) Provisional application No. 61/608,676, filed on Mar. 9, 2012.

(51) Int. Cl.
*A47L 13/22* (2006.01)
*A47L 13/12* (2006.01)

(52) U.S. Cl.
CPC ..... *A47L 13/22* (2013.01); *A47L 13/12* (2013.01); *A47L 13/225* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,392,271 | A | 7/1983 | Sepke | |
| 4,971,471 | A | 11/1990 | Sloan | |
| 5,071,489 | A | 12/1991 | Silvenis et al. | |
| 6,192,548 | B1 | 2/2001 | Huffman | |
| 6,579,023 | B2 * | 6/2003 | Kunkler et al. | 401/138 |
| 7,631,392 | B1 | 12/2009 | Meitz | |
| 7,811,022 | B2 * | 10/2010 | Bobrosky et al. | 401/270 |
| 8,267,607 | B2 * | 9/2012 | Harris | 401/139 |
| 8,807,858 | B2 * | 8/2014 | Fitzpatrick et al. | 401/138 |
| 2005/0095053 | A1 | 5/2005 | Harris | |
| 2006/0010627 | A1 | 1/2006 | Godfroid et al. | |
| 2008/0031677 | A1 | 2/2008 | Hitchner | |
| 2008/0066789 | A1 | 3/2008 | Rosenzweig et al. | |
| 2010/0205758 | A1 | 8/2010 | Levitt et al. | |
| 2012/0096670 | A1 | 4/2012 | Kim et al. | |

FOREIGN PATENT DOCUMENTS

| | | | |
|---|---|---|---|
| CN | 2482956 | Y | 3/2002 |
| DE | 102006061202 | A1 | 6/2008 |
| WO | 2008096950 | A1 | 8/2008 |
| WO | 2010078513 | A1 | 7/2010 |

OTHER PUBLICATIONS

Martin Gonzalez, G., Partial European Search Report, Jun. 19, 2015, 8 pages, European Patent Office, Munich, Germany.
Hatinder Sharma, B1—Chemical Engineering, Patent Examination Report No. 1, Dec. 24, 2013, 6 pages, Wooden, Australia.

* cited by examiner

*Primary Examiner* — David Walczak
(74) *Attorney, Agent, or Firm* — McGarry Bair PC

(57) ABSTRACT

A surface cleaning apparatus, such as a steam mop or fluid delivery mop, comprises a handle and a foot coupled to the handle for movement along a surface to be cleaned. A cleaning pad can be mounted to a lower surface of the foot and positioned to contact the surface to be cleaned. The foot comprises a viewing window for viewing the cleaning pad.

20 Claims, 34 Drawing Sheets

SURFACE CLEANING APPARATUS

CROSS-REFERENCE TO RELATED APPLICATION

This application claims the benefit of U.S. Provisional Patent Application No. 61/608,676 filed Mar. 9, 2012, which is incorporated herein by reference in its entirety.

BACKGROUND OF THE INVENTION

The invention relates generally to a surface cleaning apparatus with steam delivery. Devices such as steam mops and handheld steamers are configured for cleaning a wide variety of common household surfaces such as bare flooring, including tile, hardwood, laminate, vinyl, and linoleum, as well as countertops, stove tops and the like. Typically, steam mops comprise at least one liquid tank or reservoir for storing water that is fluidly connected to a selectively engageable pump or valve. The outlet of the pump or valve is fluidly connected to a steam generator, which comprises a heating element for heating the liquid. The steam generator produces steam, which can be directed towards the surface to be cleaned through a distributor nozzle or a manifold located in a foot or cleaning head that engages the surface to be cleaned. Steam is typically applied to the backside of a cleaning pad that is attached to the cleaning head. Steam eventually saturates the cleaning pad and the damp pad is wiped across the surface to be cleaned to remove dirt, dust, and debris present on the surface. Additionally, auxiliary liquids such as fragrances, detergents or other additives can be supplied via the liquid tank for distribution through the surface cleaning apparatus to improve cleaning efficacy or to provide other sensory benefits.

During use, the liquid contained in the reservoir is eventually depleted and must be replenished. However, it can be difficult for a user to ascertain the liquid level within the reservoir prior to or during use. The position of the reservoir on the housing, the user's viewing perspective relative to the reservoir and the opacity of the reservoir walls can all hinder a user's ability to visually ascertain the liquid level within the reservoir. Likewise, the cleaning pad is generally hidden from view when it is mounted beneath the foot or cleaning head. Additionally, in some instances, the damp cleaning pad may not entirely remove soil on the surface to be cleaning surface.

BRIEF SUMMARY OF THE INVENTION

The invention relates to a surface cleaning apparatus comprising a foot movable along a surface to be cleaned, a handle coupled to the foot for maneuvering the foot along the surface to be cleaned, a cleaning pad mounted to a lower surface of the foot and positioned to contact the surface to be cleaned, and a viewing window provided on an upper surface of the foot for viewing the cleaning pad, wherein when the foot is moved along the surface to be cleaned a user may view the cleaning pad through the viewing window.

DESCRIPTION OF EMBODIMENTS OF THE INVENTION

Figure 1:
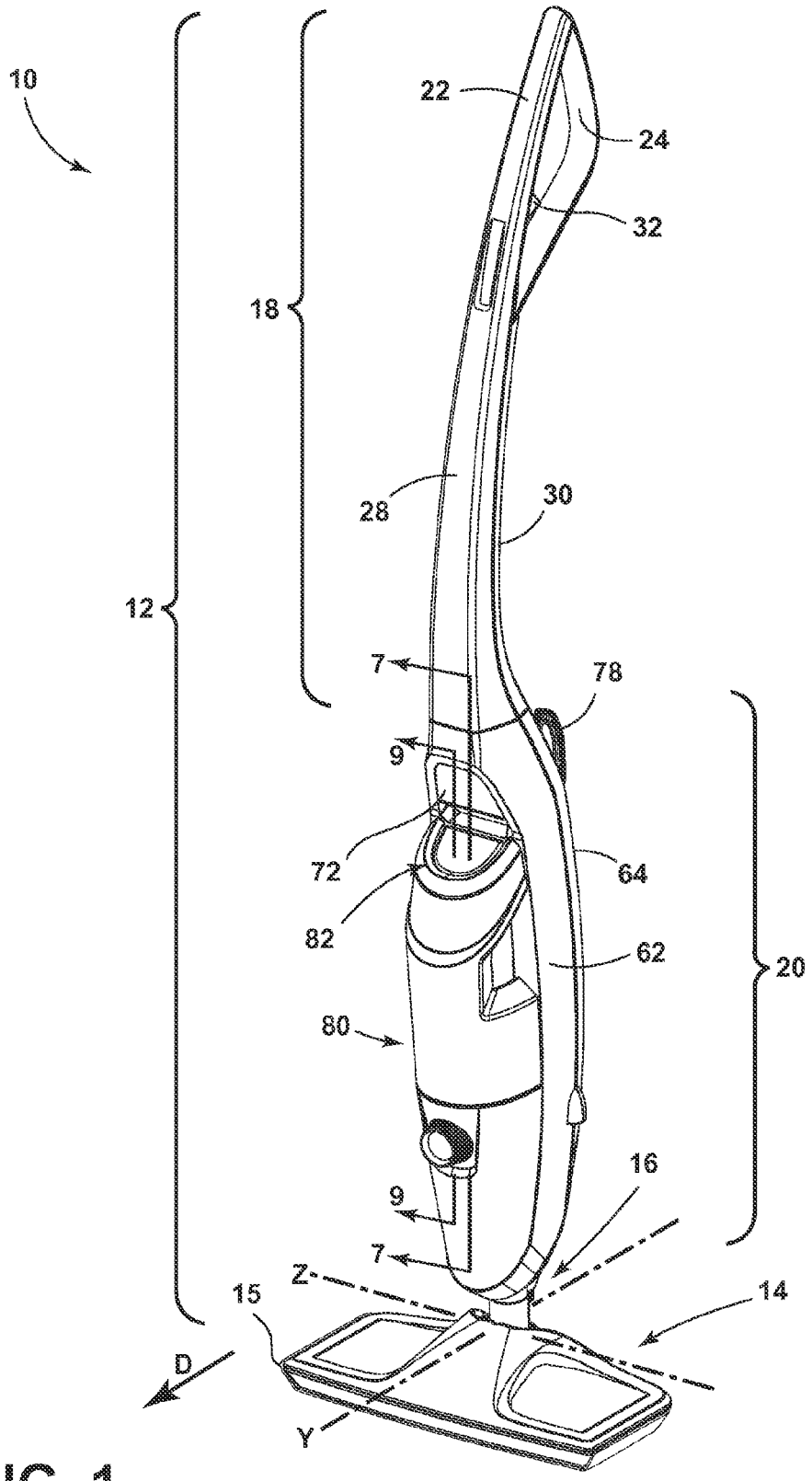
FIG. 1 is a front perspective view of a surface cleaning apparatus in the form of a steam mop according to a first embodiment of the invention.
Figure 2:
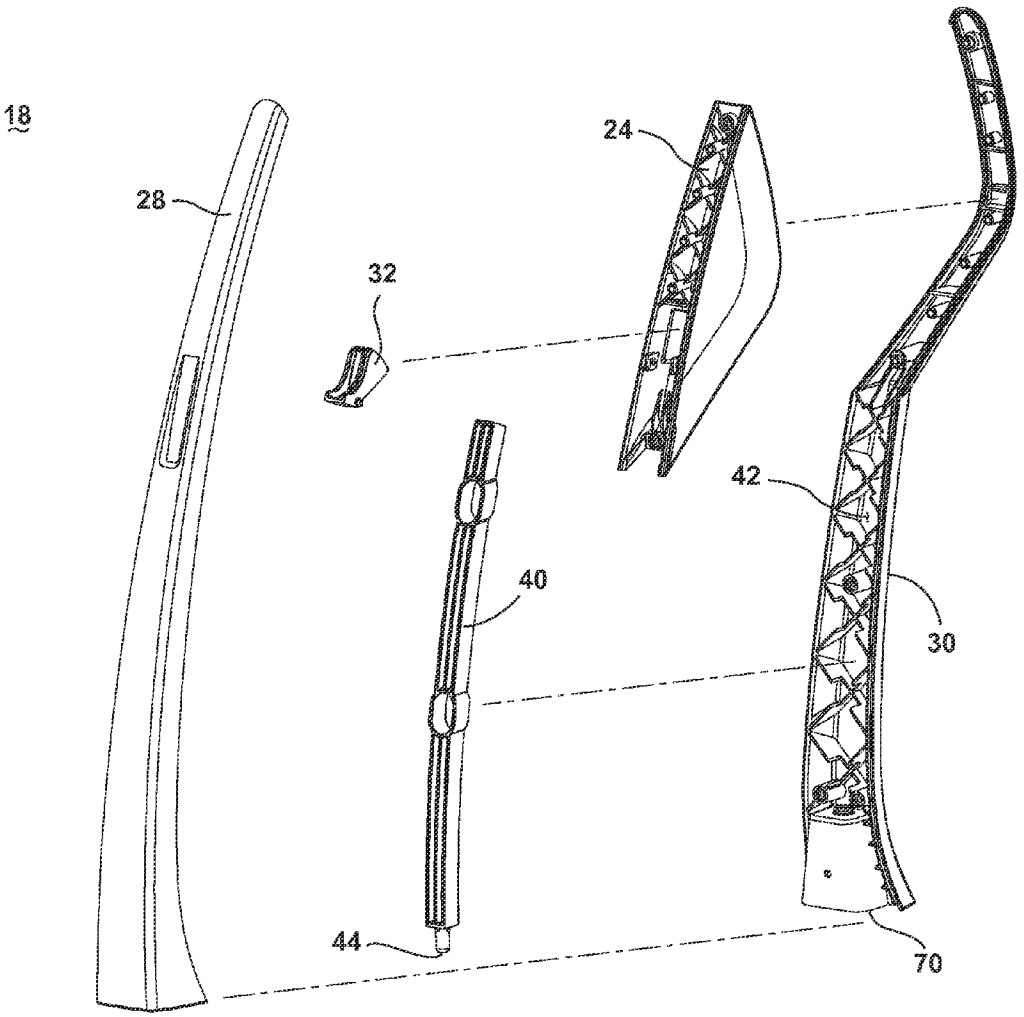
FIG. 2 is an exploded view of an upper handle portion of the steam mop of FIG. 1.

Referring to the drawings, and in particular to FIGS. 1-2, a surface cleaning apparatus according to a first embodiment of the invention comprises a steam mop 10 having a housing with an upright handle assembly 12 and a foot assembly 14. A cleaning pad 15 can be selectively received on the foot assembly 14 for wiping a surface to be cleaned.

The foot assembly 14 is swivelably mounted to the handle assembly 12 via a coupling joint 16. The handle assembly 12 can pivot from an upright, stored position, in which the handle assembly 12 is oriented substantially vertical relative to the surface to be cleaned, to a reclined, use position, in which the handle assembly 12 is pivoted rearwardly relative to the foot assembly 14 to form an acute angle with the surface to be cleaned. The coupling joint 16 can comprise a ball joint, or a universal or a Cardan joint, as further disclosed in U.S. Conventional patent application Ser. No. 12/778,615, U.S. Pat. No. 4,971,471 and Chinese Patent No. CN2482956, which are incorporated herein by reference in their entirety. The coupling joint 16 is configured to permit the handle assembly 12 to rotate about more than one axis relative to the foot assembly 14. In one embodiment, the handle 12 is configured to rotate up and down as well as side to side, relative to the foot assembly 14. The coupling joint 16 can also be configured to accommodate one or more fluid delivery conduits passing therethrough. Moreover, the coupling joint 16 can comprise a modified Cardan joint where a portion of the joint comprises a steam delivery manifold as more fully disclosed in U.S. patent application Ser. No. 13/410,580, which is incorporated herein by reference in its entirety.

The handle assembly 12 comprises an upper handle portion 18 and a lower body portion 20. A grip portion 22 at the distal end of the upper handle portion 18 is engageable by a user for directing the steam mop 10 across the surface to be cleaned. A grip insert 24 nests between opposed inboard recesses (not shown) formed in an upper handle front housing 28 and an upper handle rear housing 30. The grip insert 24 is secured between the housings via conventional fasteners (not shown). A trigger 32 is pivotally mounted to support ribs (not shown) the upper handle front housing 28. A portion of the trigger 32 protrudes through an aperture in the grip insert 24 where it is accessible for selective engagement by a user. The trigger 32 is operably connected to an upper push rod 40 that is slidably mounted within a cavity 42 formed between the upper handle front housing 28 and the upper handle rear housing 30.

Figure 3:
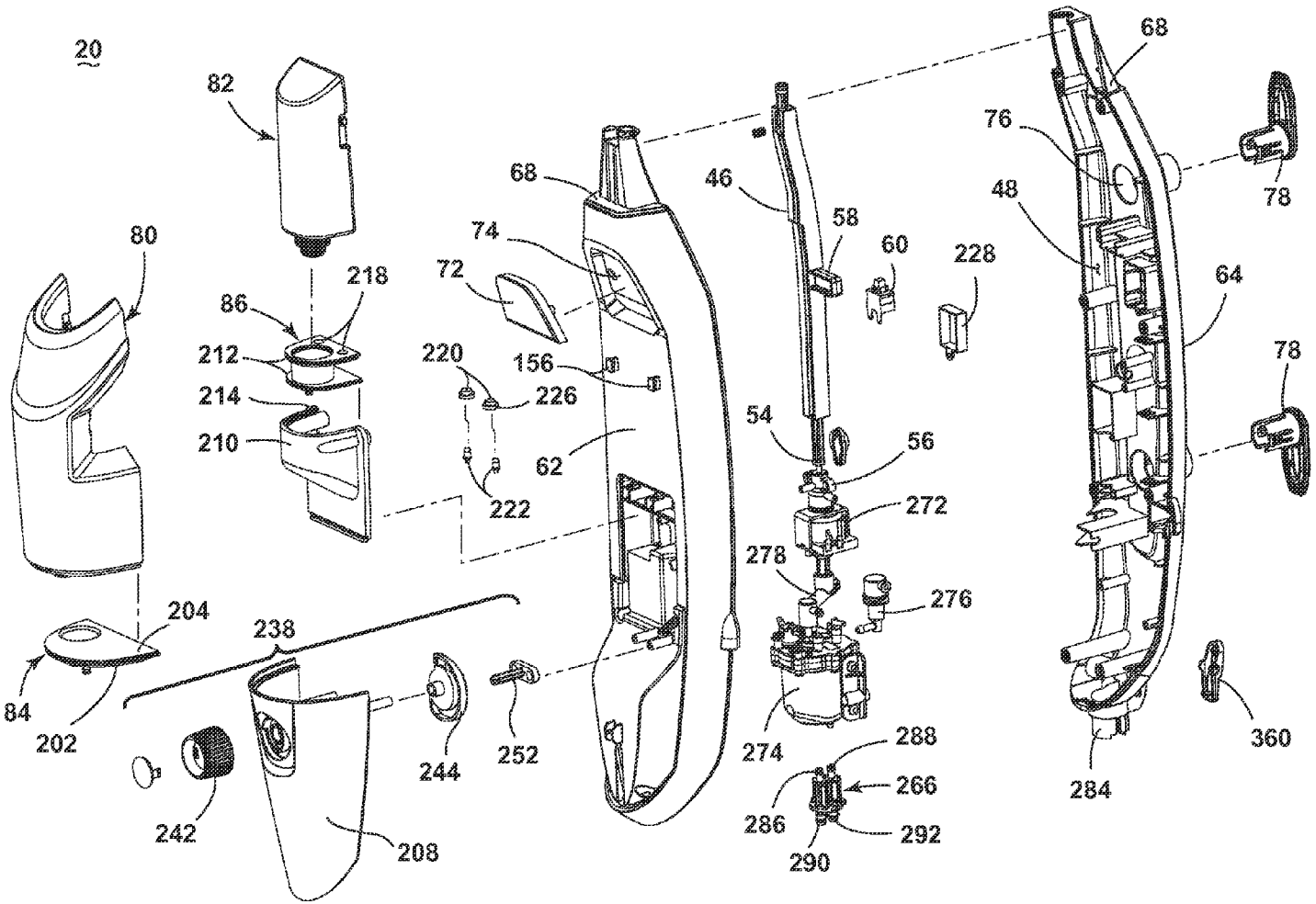
FIG. 3 is an exploded view of a lower body portion of the steam mop of FIG. 1.
Figure 3A:
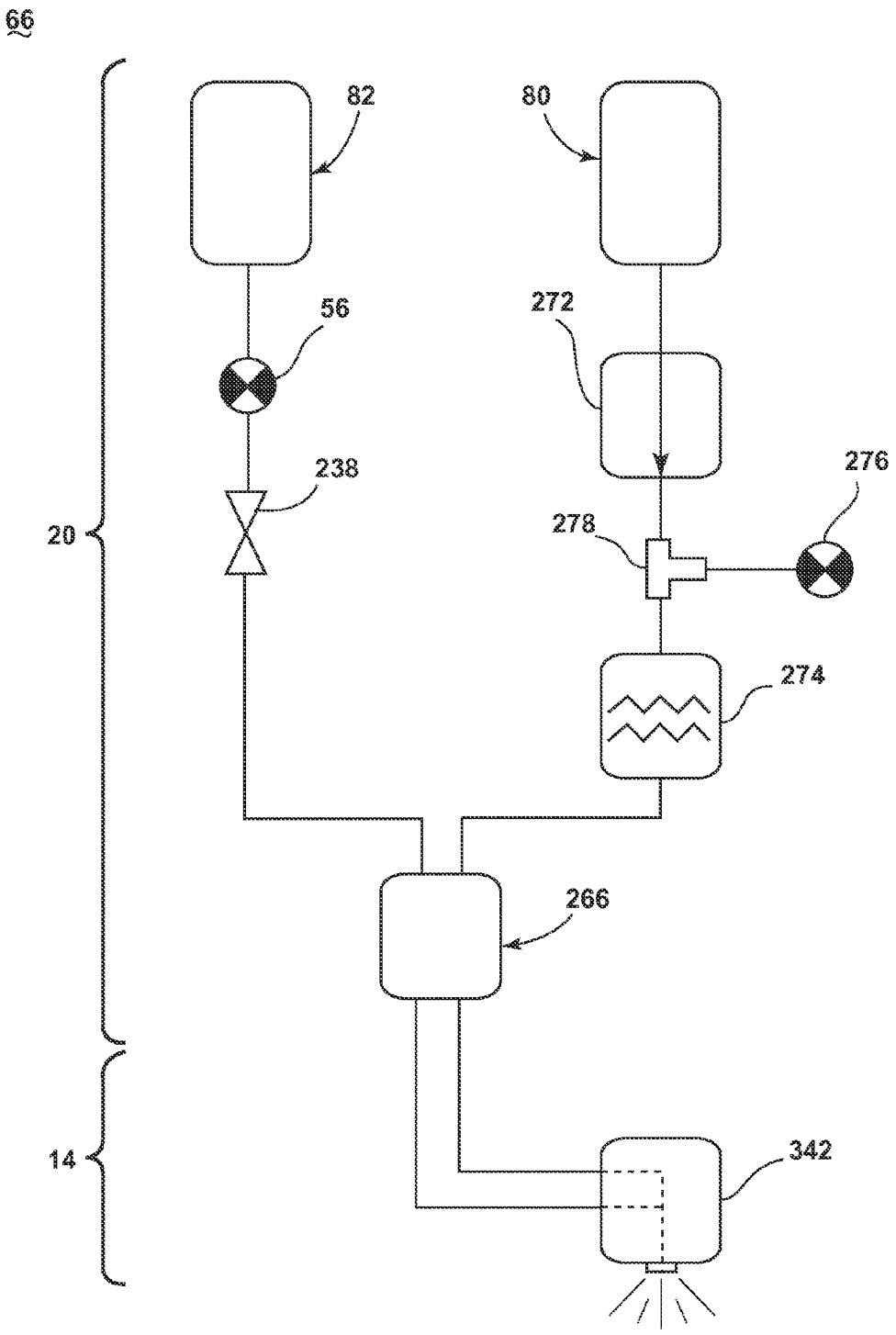
FIG. 3A is a schematic view of the fluid delivery system of the steam mop of FIG. 1.
Figure 4:
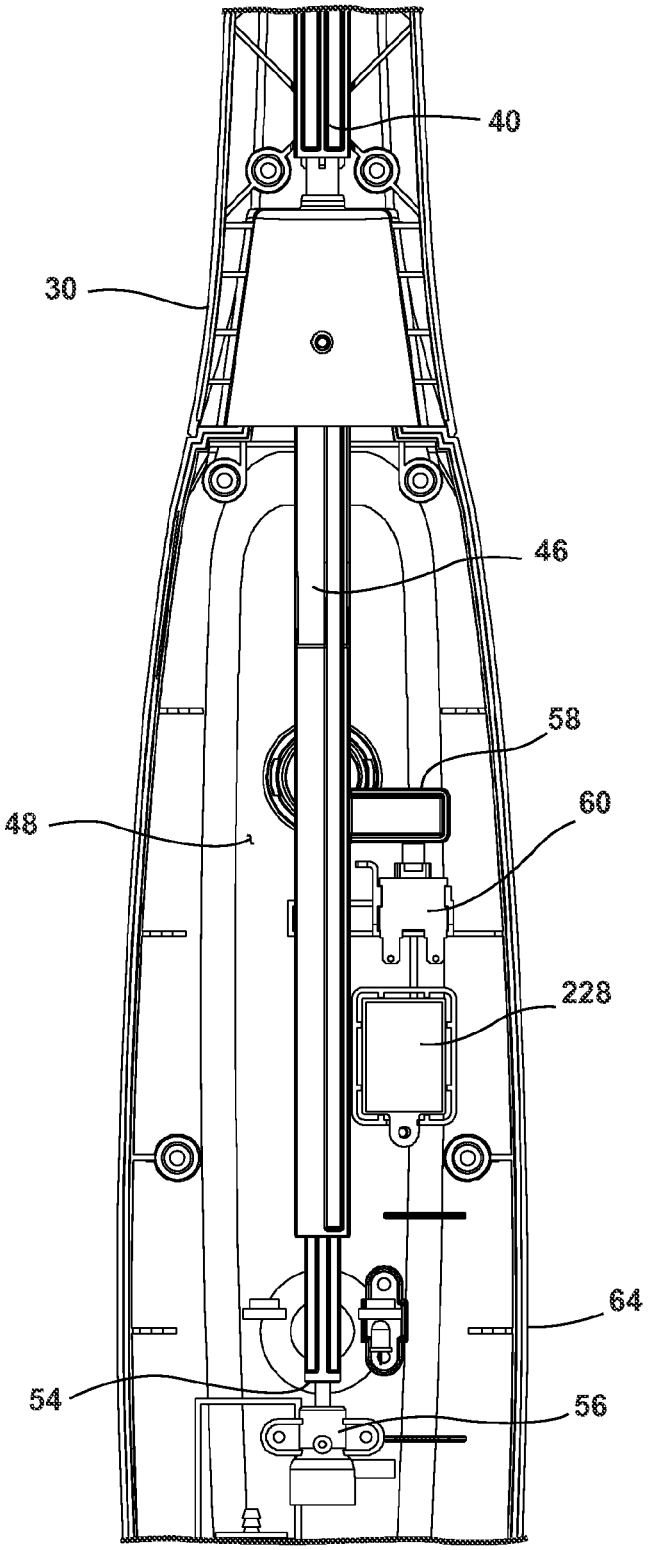
FIG. 4 is a partial plan view of the lower body portion of the steam mop with a portion of the housing removed for clarity.

Referring to FIG. 3, a bottom end 44 of the upper push rod 40 is in register with a lower push rod 46 that is slidably mounted within a cavity 48 formed in the lower body portion 20. A lower end 54 of the lower push rod 46 is in register with a mechanical plunger valve 56 that is fluidly connected to a liquid delivery system mounted in the lower body portion 20. An actuator arm 58 projects outwardly from the side of the lower push rod 46 for selectively engaging a micro-switch 60 that is operably connected to a steam delivery system 66 (FIG. 3A). FIG. 4 is a partial plan view of the steam mop with a portion of the lower body hidden and the interconnecting wiring removed to more clearly show the engagement between the lower push rod 46, plunger valve 56 and micro-switch 60.

The lower body portion 20 comprises elongated, mating front and rear enclosures 62, 64 that form a central cavity therebetween for mounting components of the steam mop 10, such as a portion of the liquid and steam delivery system 66 (FIG. 3A) of the steam mop. A stepped portion 68 at the top of the front and rear enclosures can be inserted within a corresponding socket 70 in the bottom of the upper handle portion 18 (see FIG. 2). The upper handle portion 18 and lower body portion 20 can be fastened together via mechanical fasteners to form the entire upright handle assembly 12. A badge 72 including a BISSELL® brand logo or other artwork can be prominently displayed within a corresponding pocket 74 near the top of the front enclosure. The badge 72 can be fastened within the pocket 74 via conventional fastening means such as screws, adhesive, or double-sided tape or welding, for example. The rear enclosure 64 also includes a power cord exit aperture 76 and cord wraps 78 for storing the wrapped power cord (not shown) when the steam mop 10 is not in use.

Referring to FIGS. 3 and 3A, the liquid and steam delivery system 66 is adapted to store a primary liquid and an optional auxiliary cleaning liquid, heat the primary liquid to generate steam, meter the flow of the auxiliary cleaning liquid into the steam flow path, and mix the steam and auxiliary cleaning liquid prior to delivering the steam and liquid mixture onto the cleaning surface as will be described in detail hereinafter. The fluid distribution system comprises a water tank assembly 80 and separate auxiliary liquid supply tank assembly 82 that are adapted for fluid connection to a corresponding water tank receiver 84 and auxiliary receiver 86, respectively.

Figure 5A:
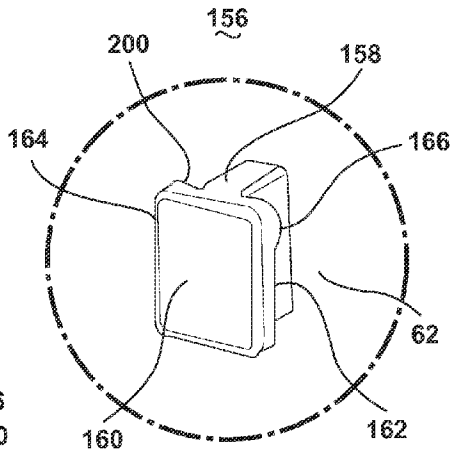
FIG. 5A is a close up view of section 5A of FIG. 5.
Figure 5:
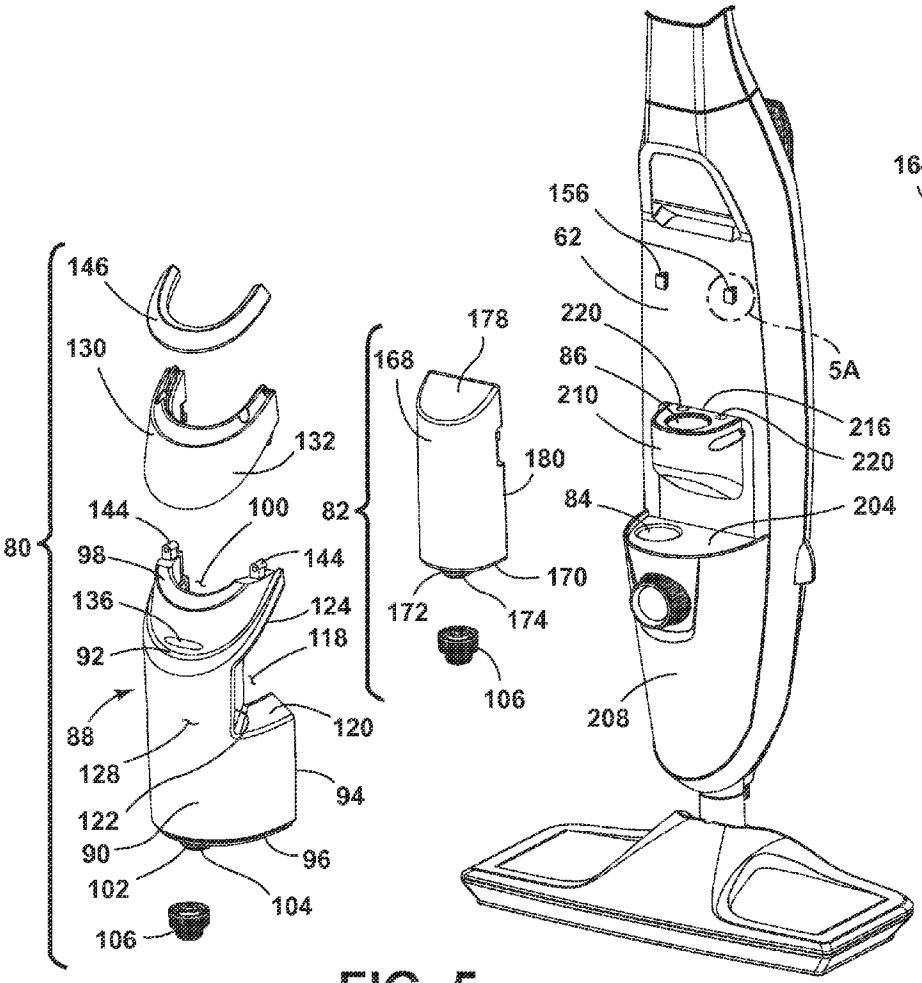
FIG. 5 is a partial exploded front perspective view of the steam mop, showing the first and second liquid supply tanks detached from the lower body portion of the steam mop.
Figure 6A:
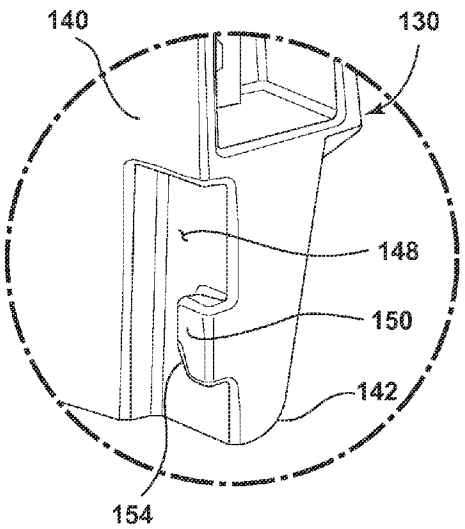
FIG. 6A is a close up view of section 6A of FIG. 6.
Figure 6:
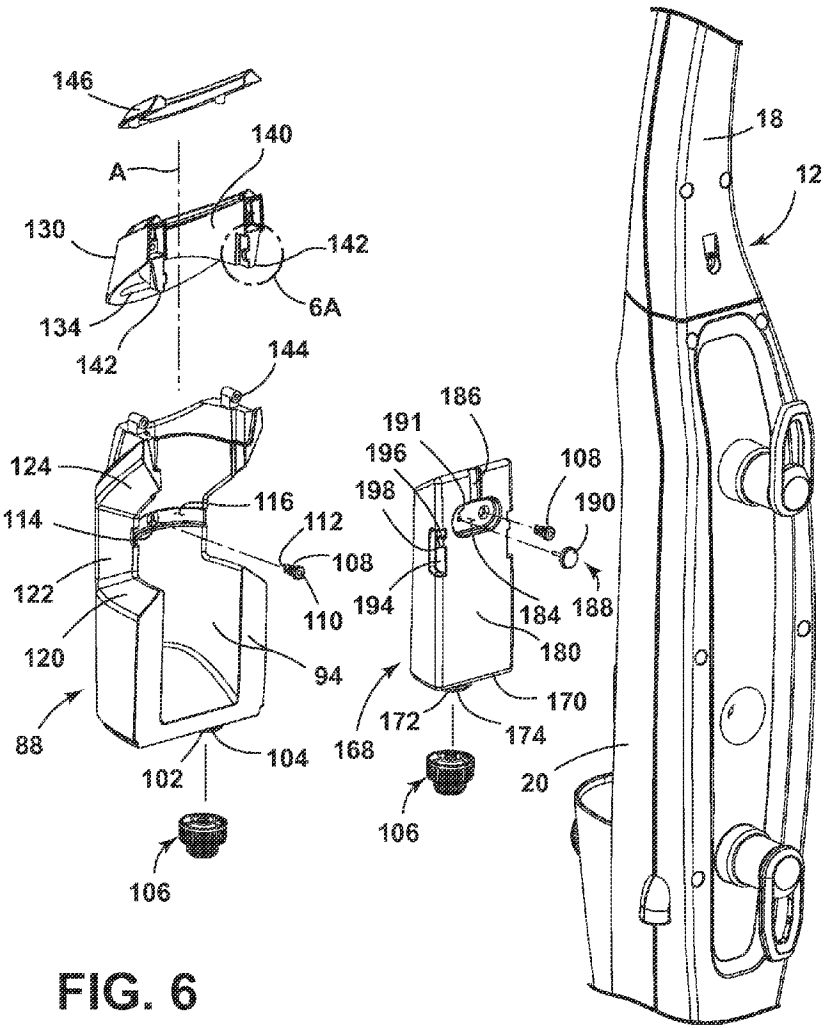
FIG. 6 is a partial exploded rear perspective view of the steam mop, showing the first and second liquid supply tanks detached from the lower body portion of the steam mop.

FIGS. 5-6 are partially exploded front and rear perspective views of the steam mop showing the water tank assembly 80 and auxiliary liquid supply tank 82 removed from the front enclosure 62. The water tank assembly 80 comprises an enclosed liquid reservoir 88 that is configured to hold a predetermined amount of liquid. The reservoir 88 is defined by a front wall 90 with a stepped upper portion 92, a rear wall 94, a flat bottom wall 96, and an angled top wall 98. A cylindrical recess 100 is formed in the rear wall 94 to nest the auxiliary liquid supply tank assembly 82. The reservoir 88 further comprises a threaded neck 102 on the bottom wall 96, which defines the liquid outlet 104, and also provides an aperture for refilling the reservoir. A one-way valve assembly 106 is removably secured to the threaded neck 102 and mates with the water tank receiver 84. The one-way valve assembly 106 can be selectively removed to re-fill the reservoir 88. A bleeder valve 108 is provided on the reservoir 88, which is illustrated as an elastomeric duckbill check valve, comprises an inlet 110 and a selectively sealable outlet 112 that is adapted to deform and open to equalize pressure between ambient atmosphere and the volume inside the liquid reservoir 88. The bleeder valve 108 is inserted into a hole 114 within a recessed vent channel 116 on the rear wall 94 so that the outlet 112 is positioned inside the liquid reservoir 88. The bleeder valve 108 is adapted to vent ambient atmospheric air surrounding the steam mop 10 through the inlet 110 and through the selectively sealable outlet 112, into the reservoir 88 when liquid inside the reservoir 88 is displaced and released through the liquid outlet 104 and introduced to the downstream components of the steam delivery system during use.

A trapezoidal-shaped side cut-out 118 is formed at each side of the reservoir 88. Each side cut-out 118 extends rearwardly from the front wall 90 and is defined by three interconnected, faceted walls and an open back. Each side cut-out 118 is defined by a substantially horizontal lower wall 120, a substantially vertical middle wall 122, a substantially angled upper wall 124 and an open back formed between the distal ends of the lower wall 120 and upper wall 124. A reservoir grip 128 is formed between the middle walls 122 of the side cut-outs 118 and the portion of the front wall 90 spanning therebetween. Because the width of the reservoir grip 128 is less than the full width of the entire reservoir 90, it provides a comfortable interface that a user can easily grasp while removing, transporting and reinstalling the water tank assembly 80 to the handle assembly 12. Additionally, a portion of the auxiliary liquid supply tank assembly 82 is visible through the side cut-outs 118, which permits a user to easily ascertain the liquid fill level inside the auxiliary liquid supply tank 82.

A cosmetic crown 130 comprises a front wall 132 with a projection 134 on the backside for engaging a corresponding indentation 136 on the stepped upper portion 92 of the reservoir 88. The crown 130 further comprises a cylindrical rear wall 140 with angled locator ribs 142 at each end. The crown 130 is designed to slide downwardly and fit snugly over the top of the reservoir 88 so that the front wall 132 mates with the stepped upper portion 92 and the projection 134 seats within the indentation 136 on the reservoir while the cylindrical rear wall 140 and angled locator ribs 142 engage a corresponding inwardly stepped portion on the back of the reservoir 88. The crown 130 can be fastened to two horizontally oriented screw bosses 144 that are located at the top of the reservoir 88. The crown 130 is preferably molded from opaque, colored plastic material and can be textured, painted or plated for desired aesthetic effect. Additionally, a U-shaped bezel 146 is configured to be fastened to the top of the crown 130 for enhancing the aesthetic appearance of the water tank assembly 80. The bezel 146 is preferably molded out of an opaque, colored plastic and can optionally be painted or chrome plated, utilizing a variety of commonly known post-molding finishing processes, such as electroplating for example.

Referring to FIGS. 5A and 6A, the crown 130 further comprises recessed retention tracks 148 on the inner surface thereof, at the ends of the cylindrical rear wall 140. Retainer tabs 150 protrude inwardly from the retention tracks 148, towards the central axis A of the tank. The tabs 150 each include an angled lead-in portion 154 at a lower portion thereof. The retention tracks 148 and retainer tabs 150 are configured to engage a corresponding pair of T-ribs 156 on the front enclosure 62. Each T-rib 156 comprises a vertical stand-off 158 that is connected to a front face 160, which is perpendicular to the stand-off 158 and spaced from the front enclosure 62. The front face 160 comprises an outer hook 162, which extends outwardly from the stand-off 158, away from the central axis of the tank, and an inner hook 164, which extends inwardly from the stand-off portion 158, towards the central axis A of the tank. Detent bumps 166 are formed along the backside of the outer hooks 162 to secure the retainer tabs 150 of the water tank assembly 80 to the front enclosure 62.

Referring to FIGS. 5-6, the auxiliary liquid supply tank assembly 82 is configured to hold a predetermined amount of auxiliary cleaning liquid, such as a liquid sanitizing agent such as accelerated hydrogen peroxide, or a disinfectant agent, detergent, fragrance or other liquid surface treatment. The auxiliary liquid supply tank 82 comprises a substantially cylindrical auxiliary reservoir 168 with a flat bottom wall 170 with a threaded neck 172 that defines an auxiliary liquid outlet 174. A second one-way valve assembly 106 is removably secured to the threaded neck 172 and mates with the auxiliary receiver 86. The one-way valve assembly 106 is configured to release liquid through the auxiliary liquid outlet 174 into the auxiliary receiver 86 when the valve 106 is actuated and it can be selectively removed to re-fill the auxiliary reservoir 168 through the threaded neck 172. The auxiliary reservoir 168 further comprises an angled top wall 178 and a flat, vertical back wall 180. A recessed vent valve seat 184 is formed at an upper portion of the back wall 180 and is fluidly connected to a recessed vertical vent channel 186. A bleeder valve 108, illustrated as an elastomeric duckbill valve, is mounted within the valve seat 184 and is adapted to vent ambient atmospheric air through the vent channel 186 and into the auxiliary reservoir 168 when liquid therein is released through the liquid outlet 174 during use, as previously described. A check valve 188, which is illustrated as an elastomeric umbrella valve, is mounted to the outer surface of the valve seat 184, adjacent to the bleeder valve 108. The check valve 188 comprises a resilient circular sealing flap 190 for selectively sealing a vent hole 191 in the back wall 180 of the reservoir. However, when excess gas is generated inside the auxiliary reservoir 168 due to potential reactions between various additives or off-gassing from peroxide formulations, for example, the pressurized gas can flow through the vent hole 191 and momentarily deform the resilient sealing flap 190, thereby venting the excess gas past the flap 191 and through the vent channel 186, into surrounding atmosphere.

Referring to FIG. 5-6A, the auxiliary reservoir 168 further comprises depressions at both sides that extend forwardly from the back wall 180 and define auxiliary tank retention tracks 194 for engaging inner hooks 164 of the T-ribs 165 on the front enclosure 62. Retainer tabs 196 protrude outwardly from each auxiliary tank retention track 194, away from the central axis of the tank. The retainer tabs 196 each include an angled lead-in portion 198 at a lower portion thereof for sliding over the top edge of the T-ribs 165. When the auxiliary liquid supply tank 82 is fully seated on the front enclosure 62, detent bumps 200 along the backside of the inner hooks 164 engage the retainer tabs 196 and retain the auxiliary tank 82 to the front enclosure 62.

Figure 7:
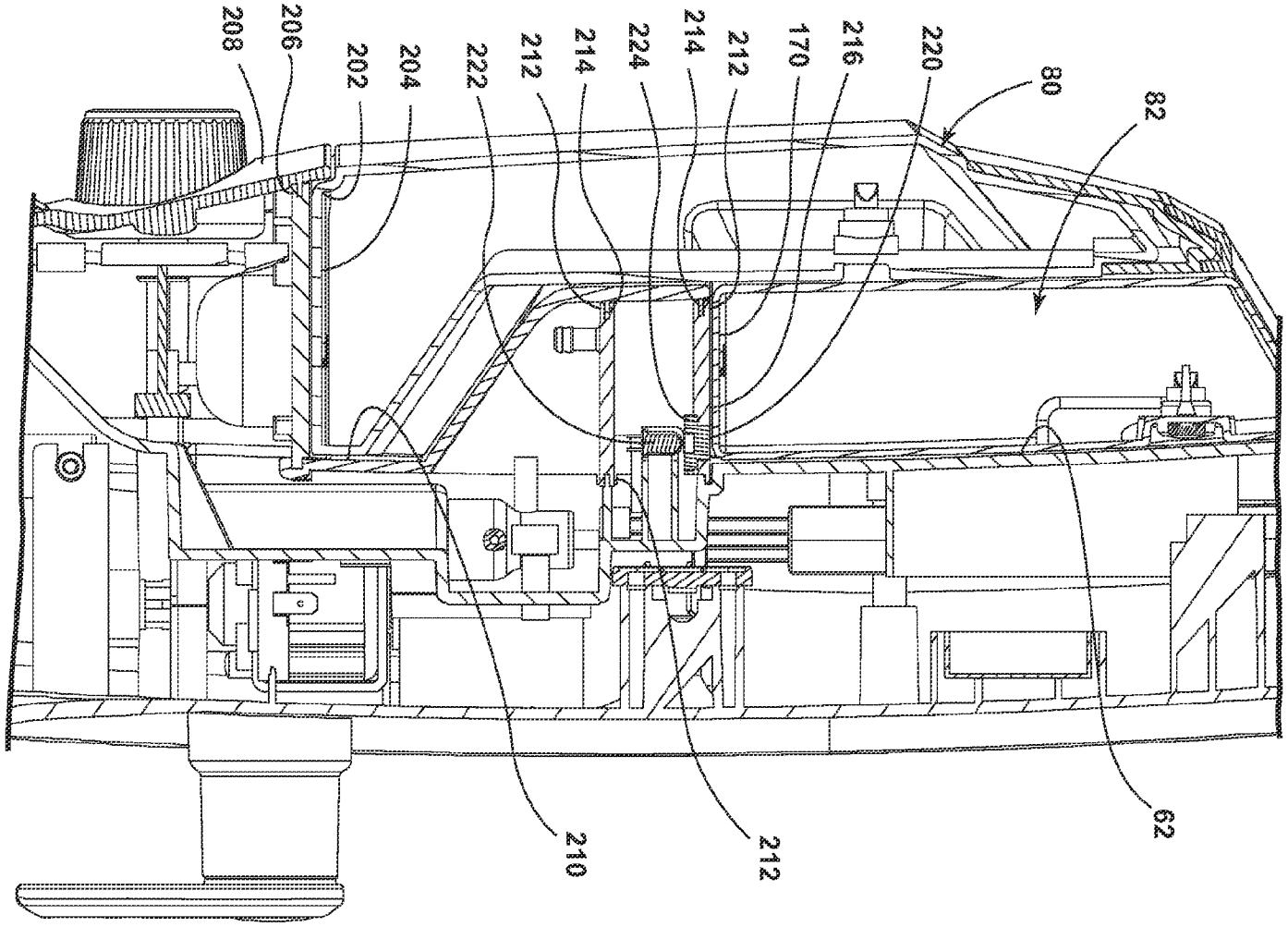
FIG. 7 is a cross-sectional view of the steam mop of FIG. 1 taken along line 7-7.

Referring to FIGS. 3, 5 and 7, the water tank assembly 80 and auxiliary liquid supply tank assembly 82 are adapted for fluid connection to a corresponding water tank receiver 84 and auxiliary receiver 86, which are both mounted to the front enclosure 62. Both tanks 80, 82 are at least partially supported by the front enclosure 62 when the tanks are mounted to the steam mop 10. The water tank receiver 84 comprises a groove 202 that wraps around the perimeter of a D-shaped tank support platform 204. The groove 202 engages a corresponding tongue 206 on the inner surface of a front cover 208 and the front enclosure 62, thus forming a robust tongue and groove joint that secures the water tank receiver 84 between the front enclosure 62 and the front cover 208.

Similarly, the auxiliary receiver 86 is secured to the front enclosure 62, above the water tank receiver 84, by a receiver cover 210 that is fastened to the front enclosure 62. The receiver cover 210 comprises a pair of vertically spaced grooves 212 that engage a pair of corresponding tongues 214 formed around the perimeter of the auxiliary receiver 86. The auxiliary receiver 86 comprises a platform 216 for partially supporting the auxiliary liquid supply tank 82 thereon. The platform 216 further comprises at least one aperture 218 for mounting at least one lens 220 therein. Alternatively, lens 220 can be mounted adjacent to either or both of the water supply tank 80 and the auxiliary liquid supply tank 82 on one or a combination of the front enclosure 62, lower body portion 20, or the water tank receiver 84, for example.

The shape and material of the lens 220 can be selected to provide the desired optical characteristics. The lens material can be transparent or translucent and adapted to transmit electromagnetic waves, especially visible light waves. For example, the lens 220 can comprise polycarbonate or acrylic plastic material. The lens material can be tinted, textured, or coated to exhibit various visual properties and appearances or to filter or diffuse the emitted light. The lens 220 can also be formed in a convex or concave shape to distribute or focus the light beams as desired.

In one embodiment, shown in FIG. 3, the platform 216 comprises two adjacent apertures 218 and the lenses 220 are press fit into the apertures 218 from beneath the platform 216. Mounting features (not shown) on the bottom surface of each lens 220 are adapted to mount light source therein, such as Light Emitting Diodes (LED) 222 shown in FIG. 3. The LEDs 222 are mounted in an orientation to emit electromagnetic waves upwardly, through the lenses 220. A horizontal lap joint 224 (FIG. 7) between a flange 226 on the lens 220 and the platform 216 wall prevents liquid on the top surface of the auxiliary receiver 86 from leaking past the lens 220 and contacting the LED 222 mounted thereunder. Alternatively, the lens 220 can include a seal that is adapted to shield the LED 222 from liquid, or the lens 220 can be welded or glued to the platform 216 to create a hermetic seal therebetween. In yet another embodiment, the entire receiver 86 can be formed out of transparent or translucent plastic and can comprise at least one integral lens formed therein.

Each LED 222 is electrically connected within a control circuit, which can comprise an intermediate Printed Circuit Board (PCB) 228 and a downstream power source, such as a battery pack or a power cord associated with a power outlet, for example, and can be energized and illuminated when power is supplied from the power source. For example, the LEDs 222 can be configured to illuminate as soon as the power cord is plugged into a power outlet. Accordingly, the LEDs 222 can provide an indication of the functional status of the steam mop 10, such as whether it is ready for use. Optionally, the PCB 228 can include additional conventional control circuitry components configured to vary the appearance of the LEDs 222, such as a multivibrator circuit that is adapted to flash or gradually pulse the LEDs 222 on and off. Moreover, the LEDs 222 can comprise a single color, such as super bright white, or, alternatively, the LEDs 222 can comprise tri-color or RGB LEDs (red, green, blue). The tri-color or RGB LEDs can be connected to suitable control circuit components on the PCB 228, such as relays and timers commonly known in the art, that are configured to fade the LEDs 222 through a predetermined color sequence or to gradually morph from one color to another. Furthermore, the LEDs 222 can selected to not only emit light wavelengths in the visible spectrum, but also the non-visible, ultraviolet spectrum, which can be beneficial for activating reactive chemistry stored within the auxiliary liquid supply tank 82 or for enhancing cleaning performance or for sanitizing either of the water tank 80 or auxiliary liquid supply tank 82, for example. In one embodiment, hydrogen peroxide can be stored in the auxiliary liquid supply tank 82 and the LEDs 222 can be configured to transmit wavelengths in the ultraviolet spectrum through the tank walls to activate the hydrogen peroxide therein for enhanced performance such as accelerated and/or improved stain removal and brightening of the surface to be cleaned, including for example, grout between floor tiles. Alternatively, the light transmitted by the LEDs 222 can include UVC wavelengths for sanitizing the auxiliary liquid supply tank 82 and fluid contained therein.

In another embodiment, an elongate light pipe or light guide can be substituted for or be incorporated in conjunction with the lens 220. The light pipe can be mounted to the front enclosure 62 with a distal end in communication with a remote light source and a proximal end in communication with either of the auxiliary liquid supply tank 82 or the water supply tank 80. The light pipe can comprise a transparent plastic material suitable for optic components such as acrylic or polycarbonate. The light pipe can be adapted to transmit light from the remote light source, through the light pipe, and to emit light through the proximal end thereof to illuminate either of the auxiliary liquid supply tank 82 or water tank 80 and to emit light through said tank walls.

In yet another embodiment, a fiber optic cable containing one or more optical fibers can replace the lens 220. The fiber optic cable can be mounted with one end in communication with the auxiliary liquid supply tank 82 and the other end in communication with a remote light source to transmit light from the light source to the auxiliary liquid supply tank 82. In one example, the light source can comprise at least one LED that is located remotely from either of the auxiliary liquid supply tank assembly 82 or the water tank assembly 80. For example, the LED can be mounted near the badge 72 and the fiber optic cable can be routed inside the lower body portion 20 to an aperture in the front enclosure 62 adjacent to either of the auxiliary liquid supply tank 82 or the water tank assembly 80 to transmit light from the LED to either of the auxiliary liquid supply tank 82 or the water tank assembly 80.

Figure 8:
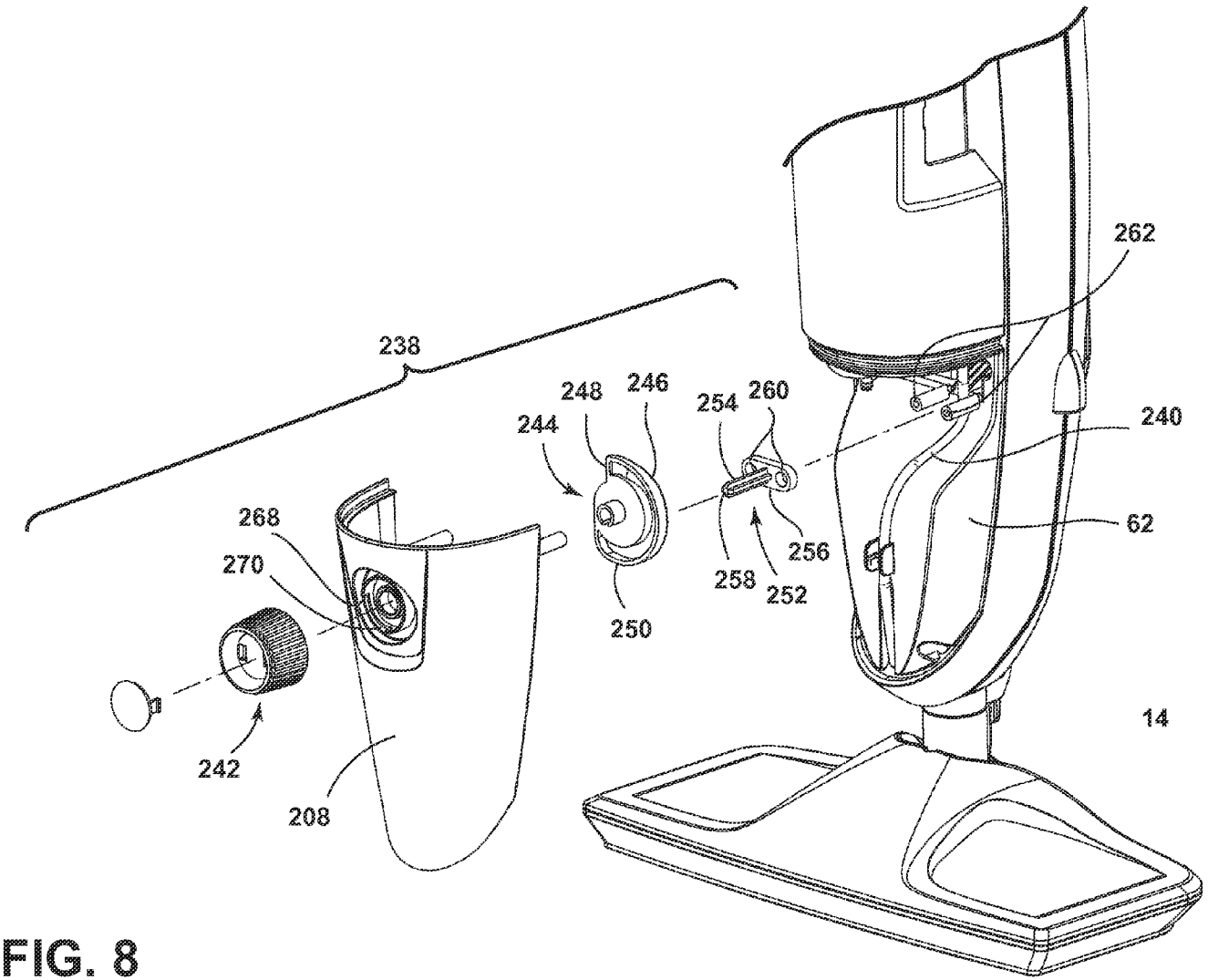
FIG. 8 is a partial exploded view of a pinch valve assembly according to the invention.

FIG. 8 shows a partial exploded view of a pinch valve assembly 238 that is mounted to the front cover 208 and front enclosure 62 for selectively restricting liquid flow through a flexible tube 240 that is fluidly connected to the outlet of the auxiliary receiver 86. The pinch valve assembly 238 comprises a rotatable knob 242 that is mounted to the front cover 208 and coupled to a cam 244 on the backside thereof. The cam 244 is a generally disk-shaped member with a raised ramp 246 around its perimeter. The ramp 246 gradually increases in height in a clockwise direction from a low point 248 at the top of the cam 244 to a high point 250 near the bottom, approximately 180 degrees apart from the low point 248 around the circumference. The ramp 246 is in register with the proximal end of a T-shaped plunger 252 that is oriented transversely between the front cover 208 and the front enclosure 62. The plunger 252 comprises an elongate plunger rod 254 connected to a tube clamp 256 portion at a distal end thereof. The plunger rod 254 further comprises a proximal end 258 that is in sliding register with the ramp 246. The tube clamp 256 comprises holes 260 near both ends that form bushing sleeves, which are adapted to slide axially along corresponding guide bosses 262 on the front enclosure 62. The backside of the tube clamp 256 is in register with flexible tubing 240 fluidly connecting the outlet of the auxiliary receiver 86 to a downstream fluid fitting 266 (FIGS. 3 and 9).

A user can selectively rotate the knob 242 between at least one of an "open" position, which permits auxiliary liquid to flow through the flexible tubing 240 and a "closed" position, which prevents auxiliary fluid from flowing through the flexible tubing 240. The "open" position corresponds to the knob 242 being rotated clockwise until an internal rib (not shown) abuts a clockwise stop 268 on the front cover 208, preventing the knob from further rotation. In this "open" position, the proximal end 258 of the plunger rod 254 is in register with the lowest point 248 of the ramp 246 and so the tube clamp 256 at the distal end of the plunger 252 does not compress the flexible tubing 264. Accordingly, the tubing 264 is unrestricted and in an un-pinched condition. Conversely, when the knob 242 is rotated counter-clockwise until the internal rib (not shown) abuts a counter-clockwise stop 270, which corresponds to the "closed" position, the ramp 246 engages the proximal end 258 of the plunger rod 254 and gradually forces the plunger 252 inwardly along the guide bosses 262. As the proximal end 258 of the plunger rod 254 slides up the ramp 246 to the highest point 250, the tube clamp 256 is forced against the flexible tubing 240 thereby compressing the tubing 240 until it is entirely pinched closed. Thus, a user can rotate the knob 242 to selectively pinch the flexible tubing 240 to meter the flow of liquid from the auxiliary liquid supply tank 82 to the downstream fluid delivery system. Although not shown in the figures, the knob 242 can comprise detents, which provide discreet "open" and "closed" positions at the respective limits of knob 242 rotation as well as additional discreet intermediate positions corresponding to cam positions that gradually compress or "pinch" the flexible tubing 240 to restrict the internal liquid flow path therein. Alternatively, the knob 242 can omit detents, rendering it entirely variable and adapted to provide infinite metering adjustability.

Figure 9:
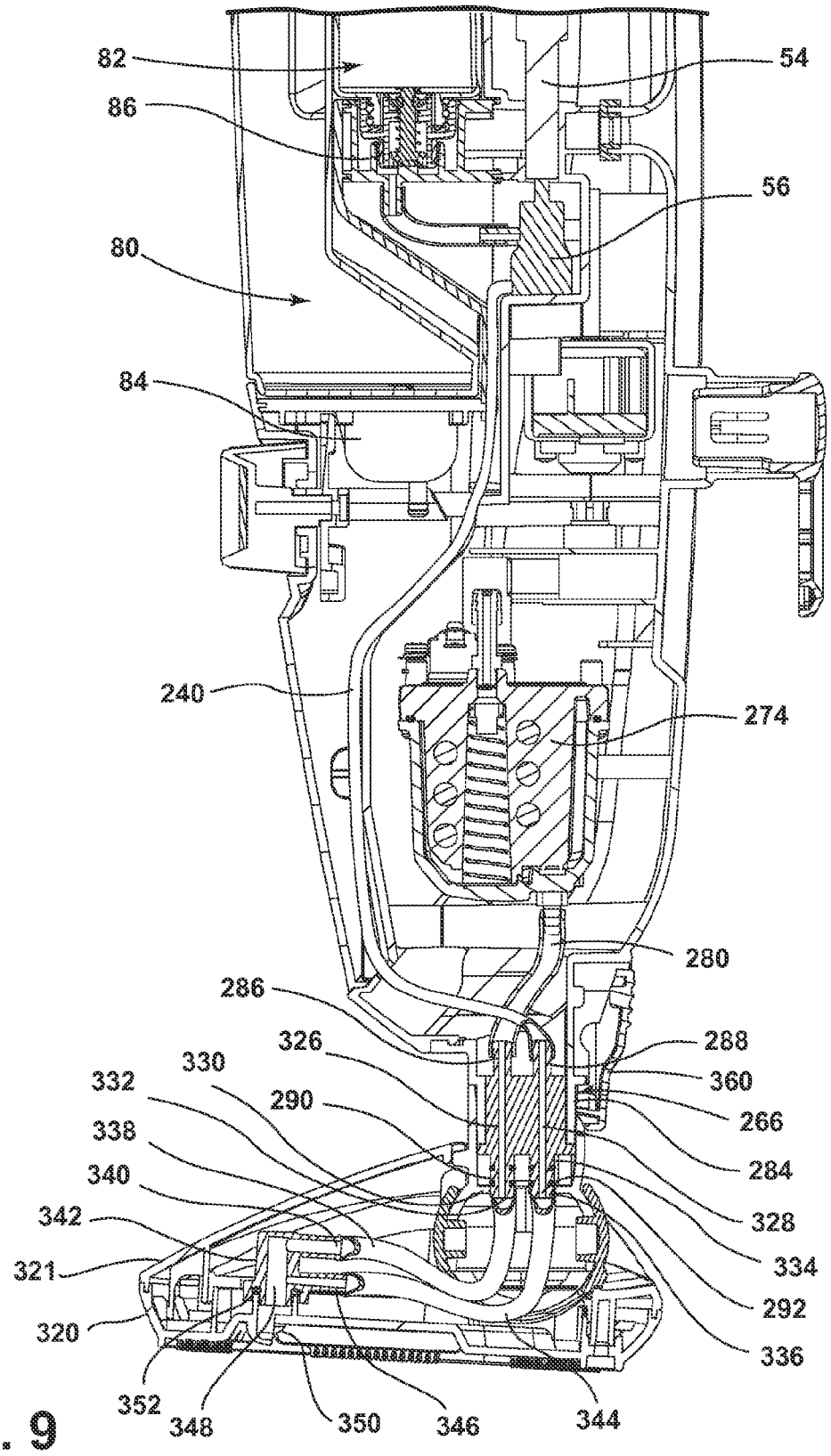
FIG. 9 is a cross-sectional view of the steam mop of FIG. 1 taken along line 9-9.

Referring now to FIGS. 3, 3A and 9, a pump 272, steam generator 274, and a pressure relief valve 276 are mounted within the central cavity 48 between the front and rear enclosures 62, 64 and fluidly connected via conventional tubing and fluid fittings. An inlet of the pump 272 is coupled with the water tank receiver 84 and an outlet of the pump 272 is fluidly connected to the steam generator 274 via one branch of a Y-shaped connection tube 278. Another branch of the Y-shaped connection tube 278 couples the outlet of the pump 272 with the pressure relief valve 276. The steam generator 274 is electrically coupled with the power cord and can be selectively energized by plugging the cord into a power outlet. The pump 272 is selectively electrically coupled with the power cord via the micro-switch 60 that is operably connected to the trigger 32 mounted in the grip 22 portion. The pump 272 can comprise a conventional solenoid pump. The PCB 228 can be configured to control the duty cycle of the pump 272 and for incorporating various electromagnetic compatibility (EMC), electromagnetic interference (EMI) and radio frequency interference (RFI) filtration components into the pump circuit as necessary. Upon energizing the steam generator 274, the pump 272 can be selectively activated to distribute steam by depressing the trigger 32, which actuates the micro-switch 60 electrically connected to the pump 272.

Alternatively, the pump 272 can be replaced by a valve (not shown) to permit liquid to flow from the water tank assembly 80 into the steam generator 274 by gravity, and, subsequently, onto the cleaning surface.

The steam generator 274 comprises a heating element for heating liquid that passes into the steam generator 274 from the pump 272. For example, the steam generator 274 can comprise a flash steam heater or a boiler for generating steam. An outlet of the steam generator 274 is fluidly connected to a fluid fitting 266 that is mounted in a lower neck portion 284 of the rear enclosure 64. The top of the fluid fitting 266 comprises a steam inlet barb 286 and a liquid inlet barb 288, which are fluidly connected to a steam outlet barb 290 and an adjacent liquid outlet barb 292 at the bottom of the fluid fitting 266. The outlet of the steam generator 274 is fluidly connected to the steam inlet barb 286 via flexible tubing 280. The auxiliary receiver 86 outlet is fluidly connected to the liquid inlet barb 288 via flexible tubing 240.

The lower neck portion 284 of the rear enclosure 64 is adapted for insertion into the coupling joint 16 of the foot assembly 14 to swivelably connect the handle assembly 12 to the foot assembly 14. The coupling joint 16 is configured to rotate back and forth about horizontal axis "Z", which extends laterally through the sides of the steam mop 10, and from side to side about axis "Y", which is orthogonal to axis "Z" and extends horizontally from the front to back, through the middle of the steam mop 10.

Figure 10:
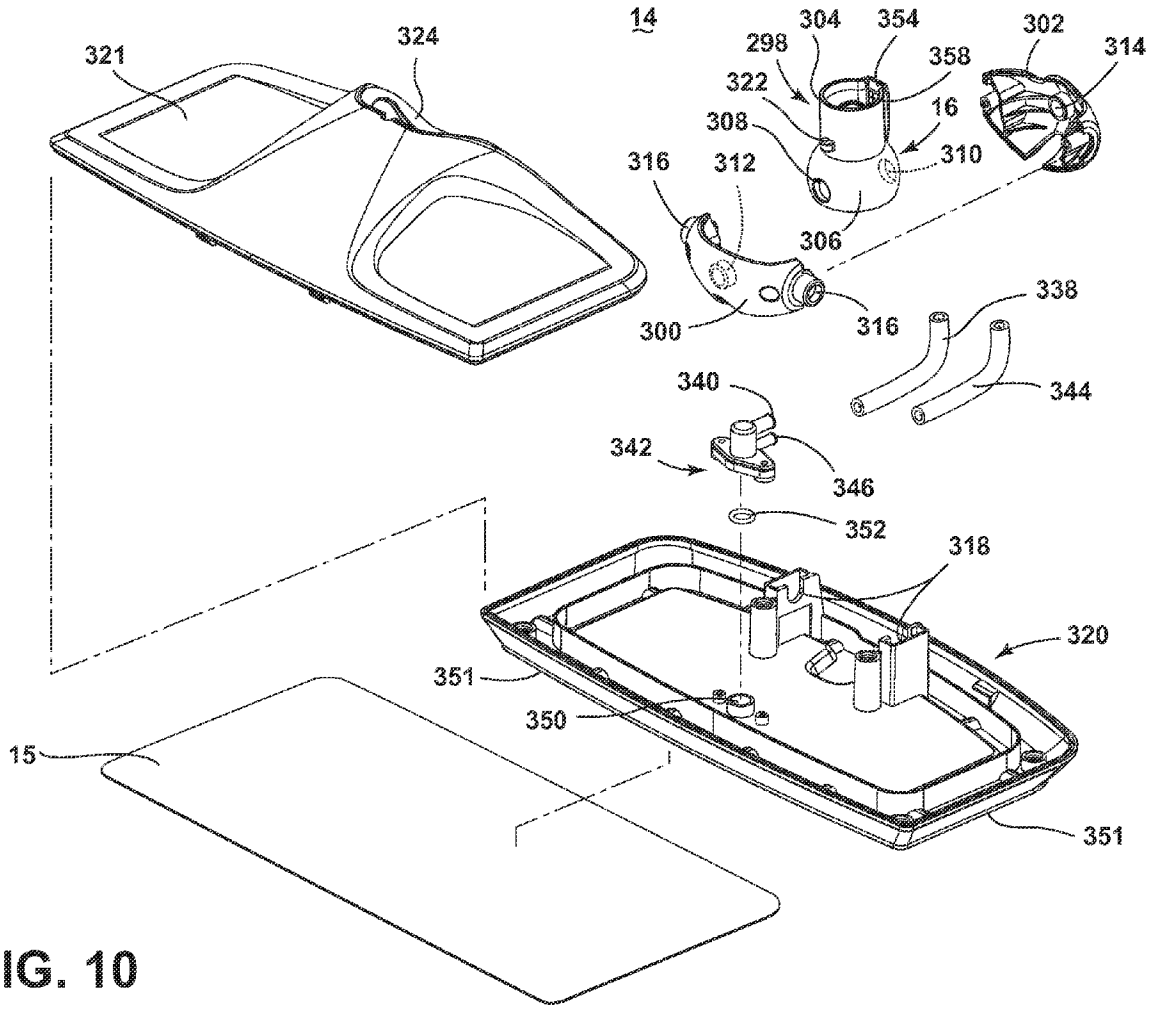
FIG. 10 is a partial exploded view of the foot assembly of the steam mop of FIG. 1.
Figure 11:
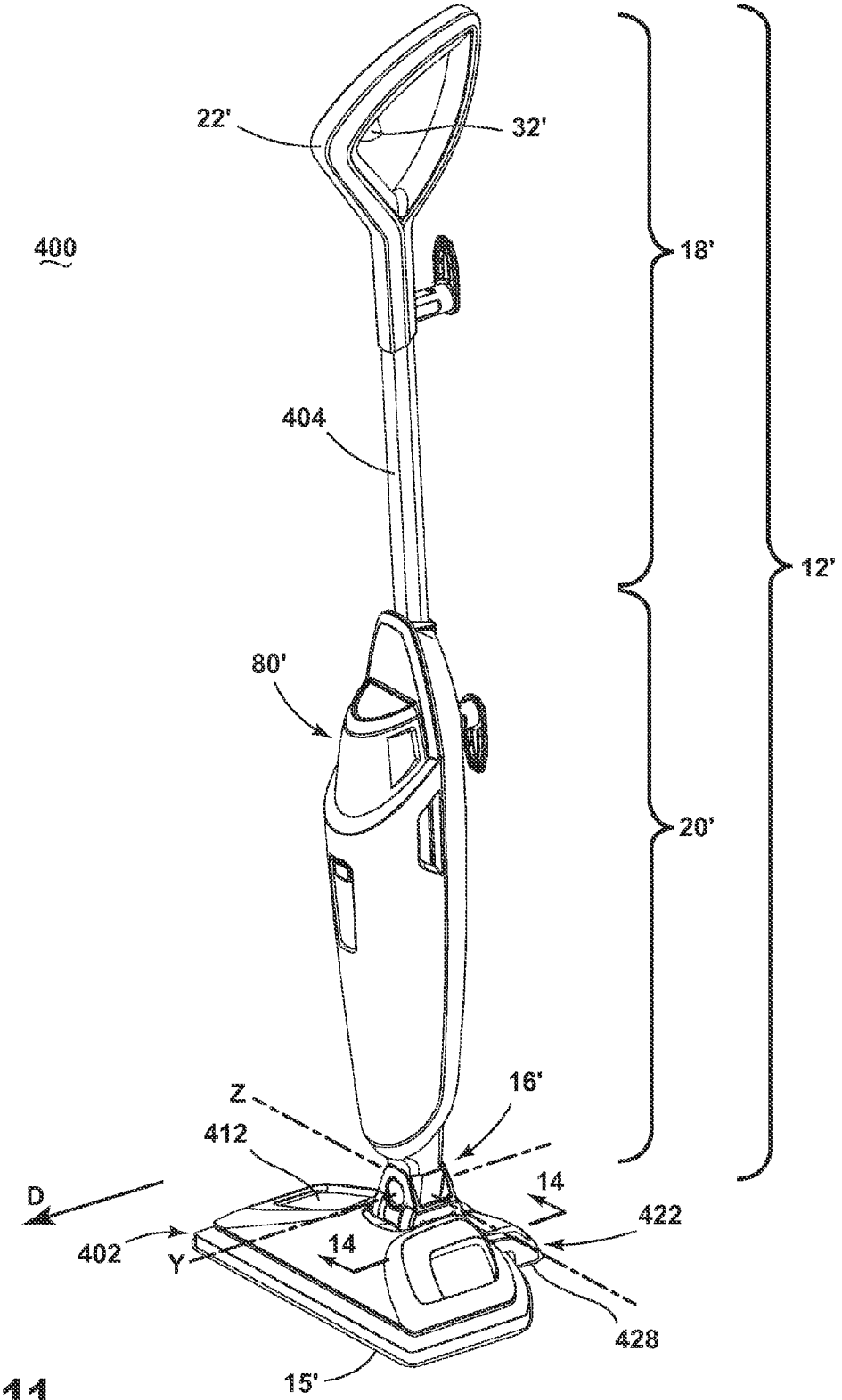
FIG. 11 is a perspective view of a steam mop according to a second embodiment of the invention.

FIG. 10 is an exploded perspective view of the foot assembly 14. The coupling joint 16 comprises a center pivot ball 298 that is cradled between a front pivot 300 and a rear pivot 302. The center pivot ball 298 is adapted for side-to-side rotation, between the front and rear pivots 300, 302 about axis "Y" (FIG. 1) as will be described hereinafter. The upper portion of the center pivot ball 298 comprises a cylindrical neck 304 that is joined to a partial spherical wall 306 with an open bottom, which forms the lower portion of the center pivot ball 298. The spherical wall 306 comprises a front hole 308 and a rear hole 310 that are adapted to rotatably receive a front pivot boss 312 that protrudes inwardly from the front pivot 300 and a rear pivot boss 314 that protrudes inwardly from the rear pivot 302. The front and rear holes 312, 314 are configured to rotate freely about the front pivot boss 312 and the rear pivot boss 314, respectively, when the front and rear pivots 300, 302 are fastened together around the center pivot ball 298. The diameters of the corresponding front hole 308 and front pivot boss 312 can be a different size relative to the diameters of the rear hole 310 and rear pivot boss 314 to prevent misassembly of the coupling joint 16.

The front pivot 300 further comprises axial pivot arms 316 that protrude outwardly from the sides of the front pivot 300, along axis "Z" (FIG. 1). The pivot arms 316 are rotatably received in corresponding cradle ribs 318 in a base housing 320. The pivot arms 316 are rotatably retained to the cradle ribs 318 by corresponding support ribs (not shown) in a cover housing 321, when the cover housing 321 is fastened to the base housing 320. Accordingly, the coupling joint 16 is adapted to rotate upwardly and downwardly about the pivot arms 316, which lie along axis "Z".

A semi-circular tab 322 protrudes off the front of the cylindrical neck 304 and is configured to engage a corresponding notch 324 on the cover housing 321 of the foot assembly 14 when the handle 12 is in the upright, storage position. When the handle 12 is returned to the upright storage position, the tab 322 is received within the notch 324 to prevent the center pivot ball 298 from pivoting from side to side about the front and rear pivot bosses 312, 314, which lie along axis "Z".

Referring to FIG. 9, the center pivot ball 298 further comprises a hollow steam passageway 326 for transmitting steam therethrough, and liquid passageway 328 for transmitting liquid therethrough. The steam passageway 326 extends through a steam receiver port 330, which is formed within the neck 304 and a coaxial steam outlet port 332, which is formed at a lower portion of the center pivot ball 298, inboard of the partial spherical wall 306. Likewise, the liquid passageway 328 is located adjacent to the steam passageway 326 and extends through a liquid receiver port 334, adjacent to the steam receiver port 330 in the neck 304 and an associated liquid outlet port 336 adjacent to the steam outlet port 332.

A flexible steam outlet tube 338 fluidly connects the steam outlet port 332 to a first inlet barb 340 on a distributor nozzle 342 that is fastened to the base housing 320. Likewise, a flexible liquid outlet tube 344 fluidly connects the liquid outlet port 336 to a second inlet barb 346 on the distributor nozzle 342, downstream from the first inlet barb 340. The steam outlet tube 338 and liquid outlet tube 344 pass through the open bottom of the center pivot ball 298 and corresponding slots (not shown) in the front pivot 300 and rear pivot 302. The distributor nozzle 342 includes an internal conduit (not shown) that merges the internal fluid flow paths from the first and second inlet barbs 340, 346 into a single distributor outlet 348, which is aligned with an aperture 350 formed in the base housing 320. An O-ring seal 352 is compressed between the distributor nozzle 342 and the aperture 350 to prevent fluid leakage. Alternatively, the coupling joint 16 can comprise a conventional Cardan joint with a flexible steam conduit routed therethrough to fluidly connect the steam outlet port 332 to the distributor nozzle 342, as is commonly known in the art.

Referring to FIGS. 9 and 10, the base housing 320 further comprises a bottom wall with a plurality of separable fasteners 351 formed integrally around the perimeter thereof for selectively mounting the cleaning pad 15 thereon. The separable fasteners 351 can comprise spear-like protuberances that are adapted to engage and selectively retain a cleaning pad 15. The protuberances can be substantially similar to those disclosed in U.S. Pat. No. 3,708,833 to Ribich et al., which is incorporated herein by reference in its entirety. Alternatively, other suitable fastening means commonly known in the art can be used such as hook and loop fasteners, elastic straps, elastic drawstring, or resilient retention members having a plurality of outwardly radiating slits for retaining the cleaning pad 15, for example. The cleaning pad 15 can comprise a dry, microfiber fabric, or any other suitable cleaning material that is preferably washable for reuse, and can additionally include a backing material to provide structure. Alternatively, the cleaning pad 15 can comprise a generally flat disposable pad or sheet. The cleaning pad 15 can optionally comprise an encapsulated formulation as disclosed in U.S. patent application Ser. No. 13/323,286, which is incorporated by reference herein in its entirety.

The back of the neck 304 comprises a keyed channel 354 that receives a complimentary keyed protrusion (not shown) on the lower neck portion 284 of the rear enclosure 64. A slot 358 in the keyed portion 354 is adapted to selectively receive a spring-biased locking latch 360 that is resiliently mounted to the lower, back portion of the rear enclosure 64.

Upon mounting the foot assembly 14 to the handle assembly 12, the steam outlet barb 290 and liquid outlet barb 292 on the fluid fitting 266 are configured to sealingly engage the steam receiver port 330 and the liquid receiver port 334 in the center pivot ball 298 of the foot assembly 14. Accordingly, a continuous fluid path is formed from the water tank assembly 80 and auxiliary liquid supply tank assembly 82 to the distributor nozzle 342 and through the distributor outlet 348.

In operation, a user prepares the steam mop 10 by pouring auxiliary liquid, like detergent for example, through the threaded neck 172 before securing the one-way valve assembly 106 thereto and mounting the auxiliary liquid supply tank 82 to the front enclosure 62. The user mounts the auxiliary tank 82 by sliding the retention tracks 194 past the inner hooks 164 of the T-ribs 156 until the detent bumps 166 clear the top edge of the retainer tabs 196 and thus secure the auxiliary liquid supply tank 82 to the front enclosure 62. When the auxiliary tank 82 is properly seated, the bottom wall 170 is at least partially supported by the platform 216 and lies adjacent to the lens 220 while the one-way valve 106 simultaneously engages the auxiliary receiver 86 and delivers auxiliary cleaning liquid to the downstream liquid supply system through the flexible tubing 240, which is connected to the outlet of the auxiliary receiver 86.

Next, a user fills the water tank assembly 80 in the same manner by first removing the one-way valve assembly 106 from the threaded neck 102 and then filling the reservoir 88 with water. The user then secures the one-way valve assembly 102 to the threaded neck 102 and installs the water tank assembly 80 onto the front enclosure 62 by sliding the retention tracks 148 over the outer hooks 162 of the T-ribs 156 until the detent bumps 166 engage the top of the retainer tabs 150, thus securing the water tank assembly 80 to the front enclosure 62. When the water tank assembly 80 is properly seated, the bottom wall 96 is at least partially supported by the water tank receiver 84 while the one-way valve 106 simultaneously engages the water tank receiver 84 and delivers liquid to the downstream liquid supply system through a second flexible tube (not shown), which is connected to the outlet of the water tank receiver 84.

Next, a user selectively depresses the trigger 32 to distribute fluid through the apparatus onto the cleaning surface. A portion of the trigger 32 pushes the upper push rod 40, which slides downwardly within cavity 42 and forces the lower push rod 46 downwardly within cavity 48. The lower end 54 of the lower push rod 46 actuates the plunger valve 56 that is fluidly connected to the auxiliary liquid supply tank 82 and the actuator arm 58, which is also on the lower push rod 46, simultaneously actuates a micro-switch 60 that is electrically connected to the pump 272 for selectively energizing the pump 272. Water from the water tank assembly 80 flows through the one-way valve assembly 106 and water tank receiver 84. The pump 272 conveys the water into the steam generator 274 where the water is converted at least partially into steam. Next, the pump 272 forces steam through steam passageway 326 and associated steam outlet tube 338, into a first inlet barb 340 and through the distributor nozzle 342 where liquid from the auxiliary liquid supply tank 82 mixes with the steam and is distributed through the distributor outlet 348 and aperture 350 in the base housing 320 and onto the backside of the cleaning pad 15 for distribution onto the surface to be cleaned.

Liquid from the auxiliary liquid supply tank 82 flows through the one-way valve assembly 106, through the auxiliary receiver 86, through the plunger valve 56 (when it is actuated by the lower push rod 46), and downstream flexible tubing 240 that can be selectively restricted or variably metered by adjusting a pinch valve 238. To increase the flow of auxiliary liquid, the user can rotate the knob 242 of the pinch valve 238 counter-clockwise to decrease engagement between the associated cam 244 and plunger 252, and thus reduce the level of compression between the plunger 252 and the tubing 240. Conversely, a user can maximize auxiliary liquid flow by rotating the knob 242 to the clockwise stop 268, which corresponds to the position in which the plunger rod 254 is in register with the lowest point of the ramp 246 on the cam 244 so that the flexible tubing 240 is in an unrestricted an un-pinched condition.

Alternatively, if a user wants to reduce the flow of auxiliary cleaning liquid, the user can rotate the knob 242 counter-clockwise which forces the cam 244 against the plunger 252 to gradually pinch the flexible tubing 240 and thus restrict flow of auxiliary cleaning fluid therethrough. Moreover, to completely block the flow of the auxiliary cleaning liquid, the user can rotate the knob 242 to the counter-clockwise stop 270 so that the high point 250 of the ramp 246 forces the plunger 252 inwardly to pinch the flexible tubing 240 entirely closed to block the flow of liquid therethrough.

When the knob 242 is rotated to a position so that the flexible tubing 240 is at least partially un-pinched, the liquid from the auxiliary liquid supply tank 82 flows through the flexible tubing 240, into the liquid passageway 328 and through the liquid outlet port 336 in the coupling joint 16, through the second inlet barb 346 of the distributor nozzle 342 whereupon it mixes with the steam flowing through the first inlet barb 340, and whereupon steam and liquid mixture is distributed simultaneously through the distributor outlet 348 onto the cleaning pad 15, which is wiped across the surface to be cleaned.

When the steam mop 10 is energized, electricity flows through the control circuit and is delivered to LEDs 222, which are mounted in the receiver platform 216. Each LED 222 illuminates and light waves are emitted upwardly through the lenses 220, which are also mounted in the auxiliary receiver 86 platform 216. Light is transmitted and dispersed through the lenses 220 and through the at least partially transparent bottom wall 170 of the auxiliary liquid supply tank 82, the fluid contained therein and the outer walls of the auxiliary reservoir 168. Accordingly, the auxiliary liquid supply tank 82 is illuminated so that a user can see the contents of the auxiliary liquid supply tank 82. Additionally, the illuminated, glowing auxiliary liquid supply tank 82 provides a pleasing aesthetic effect.

A surface cleaning apparatus according to a second embodiment of the invention is shown in FIGS. 11-16. Because many of the components of this embodiment are similar to the previous embodiment, like features are indicated with the same reference numeral bearing a prime (') symbol. Any of the previously described features, including LED illumination components, can be incorporated into the following embodiment of the invention.

The surface cleaning apparatus comprises a steam mop 400 with an upright handle assembly 12' that is substantially similar to the previous embodiment. The upright handle assembly 12' is swivelably mounted to a foot assembly 402 through a coupling joint 16'. A cleaning pad 15' can be selectively received on the foot assembly 402 for wiping a surface to be cleaned. The coupling joint 16' can comprises a multi-axis Cardan joint as shown in the figures, but can alternatively comprise a ball joint to swivelably connect the foot assembly 402 to the upright handle assembly 12'. The coupling joint 16' is adapted to pivotally connect the foot assembly 402 to the handle assembly 12' and defines a first axis, "Z", which is generally perpendicular to the axis defining the direction of travel D of the steam mop 10. The handle 12' can be pivoted from front-to-back with respect to the foot assembly 402 about axis "Z". The coupling joint 16' further defines a second axis, "Y", which is generally parallel to the axis defining the direction of travel D of the steam mop 400, and about which the handle 12' can be pivoted from side-to-side with respect to the foot assembly 402. Accordingly, the coupling joint 16' is configured to permit the foot assembly 402 to swivel multi-axially with respect the handle assembly 12'.The upright handle assembly 12' comprises an upper handle portion 18' and a lower body portion 20'.

A steam distribution system is mounted within the handle assembly 12', the foot assembly 402 or a combination thereof, and can be substantially similar to the steam distribution system 66 described for the first embodiment and schematically shown in FIG. 3A, with the exception that the steam distribution system is only provided with a single tank assembly, water tank assembly 80'. Thus, in this embodiment, the auxiliary liquid supply tank assembly 82, plunger valve 56, the pinch valve 238, the fluid fitting 266, and other components associated with the auxiliary supply of liquid can be eliminated. As such, the fluid distributor nozzle 342' (FIG. 13) need only receive steam via the steam outlet tube 338'. The upper handle portion 18' has a grip 22', a trigger 32', a handle tube 404 and a push rod arrangement as discussed above for the first embodiment slidably mounted within the handle tube 404 and configured to actuate steam distribution as previously described. Other bare floor steam cleaners with similar fluid distribution control systems are disclosed in US2010/0287716 and WO2011019814, which are incorporated herein by reference in their entirety.

Figure 12:
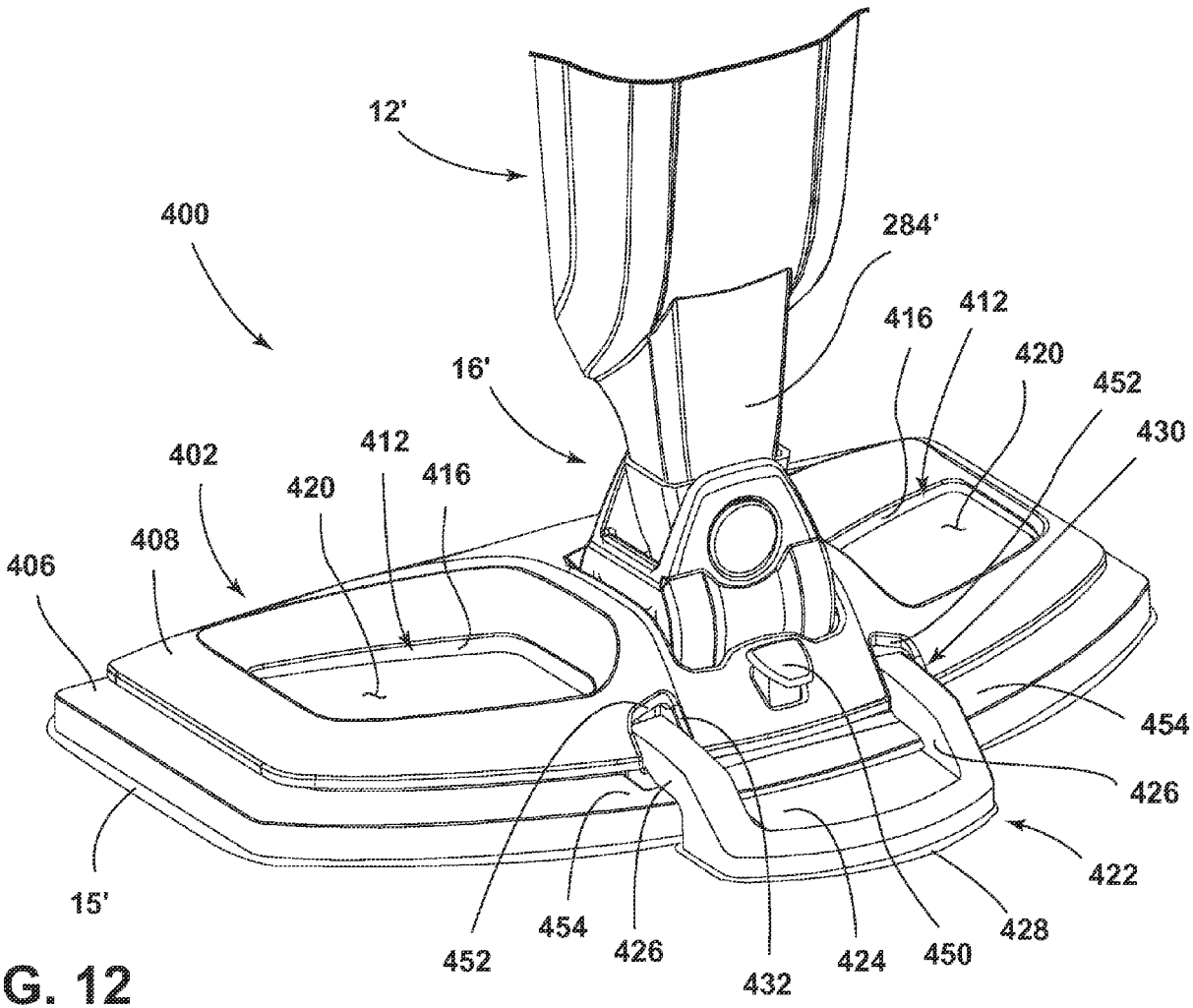
FIG. 12 is a rear perspective view of the foot of the steam mop of FIG. 11.
Figure 13:
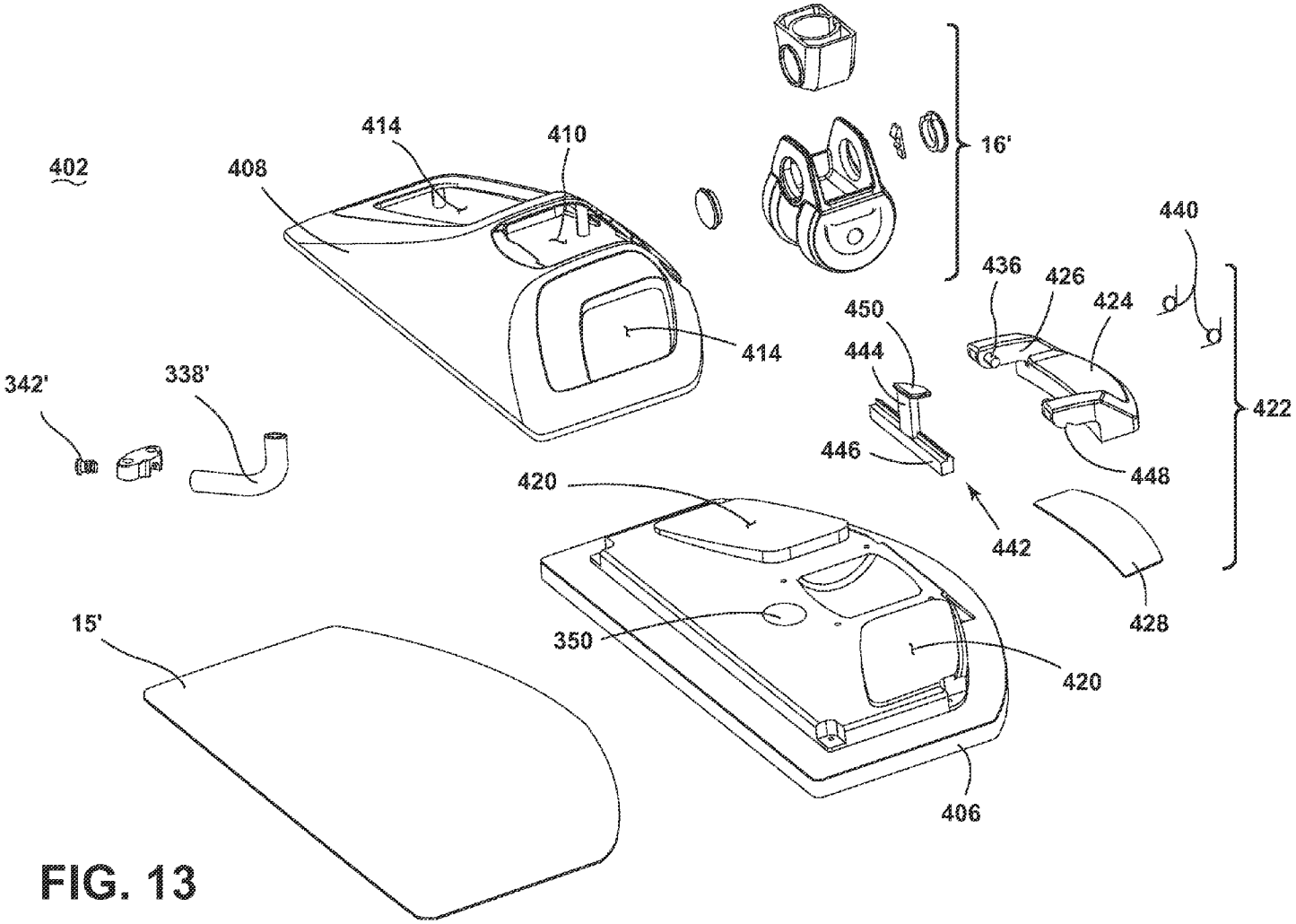
FIG. 13 is an exploded view of the foot of the steam mop of FIG. 11.

Referring to FIGS. 12 and 13, the foot assembly 402 further comprises a base housing 406 and a cover housing 408 attached to the base housing 406 via fasteners (not shown). The base housing 406 preferably comprises a translucent material that can further optionally comprise a colored tint. The coupling joint 16' is pivotally mounted at a rearward portion of the foot assembly 402 between the base housing 406 and the cover housing 408. A portion of the coupling joint 16' protrudes through an opening 410 in the cover housing 408. A lower portion of the coupling joint 16' is pivotally supported by mating cradle ribs (not shown) that are formed inside the base housing 406 and along the sides of the opening 410 in the cover housing 408. The cradle ribs pivotally attach the coupling joint 16' to the foot assembly 402. An upper portion of the coupling joint 16' is further configured to detachably receive the lower neck portion 284' of the lower body portion 20' as is commonly known in the art.

The cover housing 408 further comprises a viewing window 412 through the top of the cover housing 408 and located on each side of the opening 410 that accommodates the coupling joint 16'. Each window 412 comprises a trapezoidal cutout 414 bounded by a substantially vertical wall 416 that extends downwardly from the top surface of the cover housing 408. The vertical wall 416 defines the perimeter of the viewing window 412 for viewing the base housing 406, cleaning pad 15' and steam condensation therebetween. The vertical wall 416 mates against a flat top surface 420 of the base housing 406, which is formed of a transparent or translucent material. The distributor nozzle 342' is mounted to an aperture 350' on the base housing 406. Steam channels (not shown) on the bottom of the base housing 406 are configured to guide steam from the distributor nozzle 342', evenly across the base housing 406, and past the translucent viewing windows 412. Accordingly, a user can look through the viewing windows 412 observe the condensation of the steam vapor while using the steam mop 400 on the surface to be cleaned. Moreover, a user can easily confirm whether a cleaning pad 15' is installed beneath the base housing 406 prior to using the steam mop 400. Although the viewing windows 412 have been described as being integral to a translucent base housing 406, it is also contemplated that separate, transparent viewing windows could be fastened to corresponding cutouts in an opaque base housing in an alternate configuration to achieve similar results.

A movable agitator assembly 422 is provided on a rear portion of the steam mop foot assembly 402; however, the invention is equally applicable to cleaning attachments for canister and upright steam mops and on wet mops, for example. As illustrated herein, the movable agitator assembly 422 is pivotally coupled to a rear portion of the foot assembly 402 and is configured for movement between a first position shown in FIG. 15 and a second position shown in FIG. 16. In the first position, the movable agitator assembly 422 is in a use position and contacts the surface to be cleaned to provide enhanced, localized agitation of the surface to be cleaned whereas, in the second position, the movable agitator assembly 422 is in a non-use position and does not contact the surface to be cleaned.

The movable agitator assembly 422 comprises an agitator support frame 424 with support arms 426 extending perpendicularly from the ends thereof. The bottom of the support frame 424 is adapted to receive an agitator element 428 that is separate from the cleaning pad 15'. The support frame 424 can include separable fasteners (not shown) such as hook and loop fasteners, for example, that are configured to detachably secure an agitator element 428 to the support frame 424.

Alternatively, the agitator element 428 can be permanently affixed to the support frame 424.

The agitator element 428 is configured to be attached or otherwise supported by the support frame 424 and extends substantially across the width of the support frame 424, which partially spans the back portion of the base housing 406. The agitator element 428 can comprise a variety of materials that are configured to agitate the surface to be cleaned. The agitator element 428 can comprise materials that are dissimilar from the cleaning pad 15'. Moreover, the thickness of the agitator element 428 can optionally be greater than the thickness of the cleaning pad 15' to ensure that the agitator element 428 contacts the surface to be cleaned when the movable agitator assembly 422 is in the first, in-use position. For example, the agitator element 428 can comprise an elongated strip of scouring pad material, a tufted bristle block, an elastomeric block with spaced projections or nubs, a non-woven material, a micro-fiber material, a cellulose sponge, a strip of open cell melamine resin foam, such as Basotect®, which is commercially available from BASF Corp., or any other materials suitable for agitating a soiled surface to be cleaned without damaging said surface. The agitator element 428 can comprise a combination of materials with different textures. Moreover, the agitator element 428 can be pre-moistened or coated with a cleaning composition to enhance cleaning performance of the agitator assembly 422.

The movable agitator assembly 422 further comprises a mounting assembly 430 for pivotally mounting the support frame 424 to the foot assembly 402. The mounting assembly 430 can comprise a pair of spaced brackets 432 defined by mating cradle ribs (not shown) that can be formed in the cover housing 408 and base housing 406. Alternatively, the spaced brackets can comprise individual bearing components that are affixed to either or a combination of the base housing 406 and the cover housing 408. A pivot pin 436 extends inwardly from the distal end of each support arm 426. Each pivot pin 436 is rotatably coupled with a corresponding bracket 432 by a pivot coupling (not shown), to hingedly connect the pin 436 to the mating cradle ribs.

Figure 16:
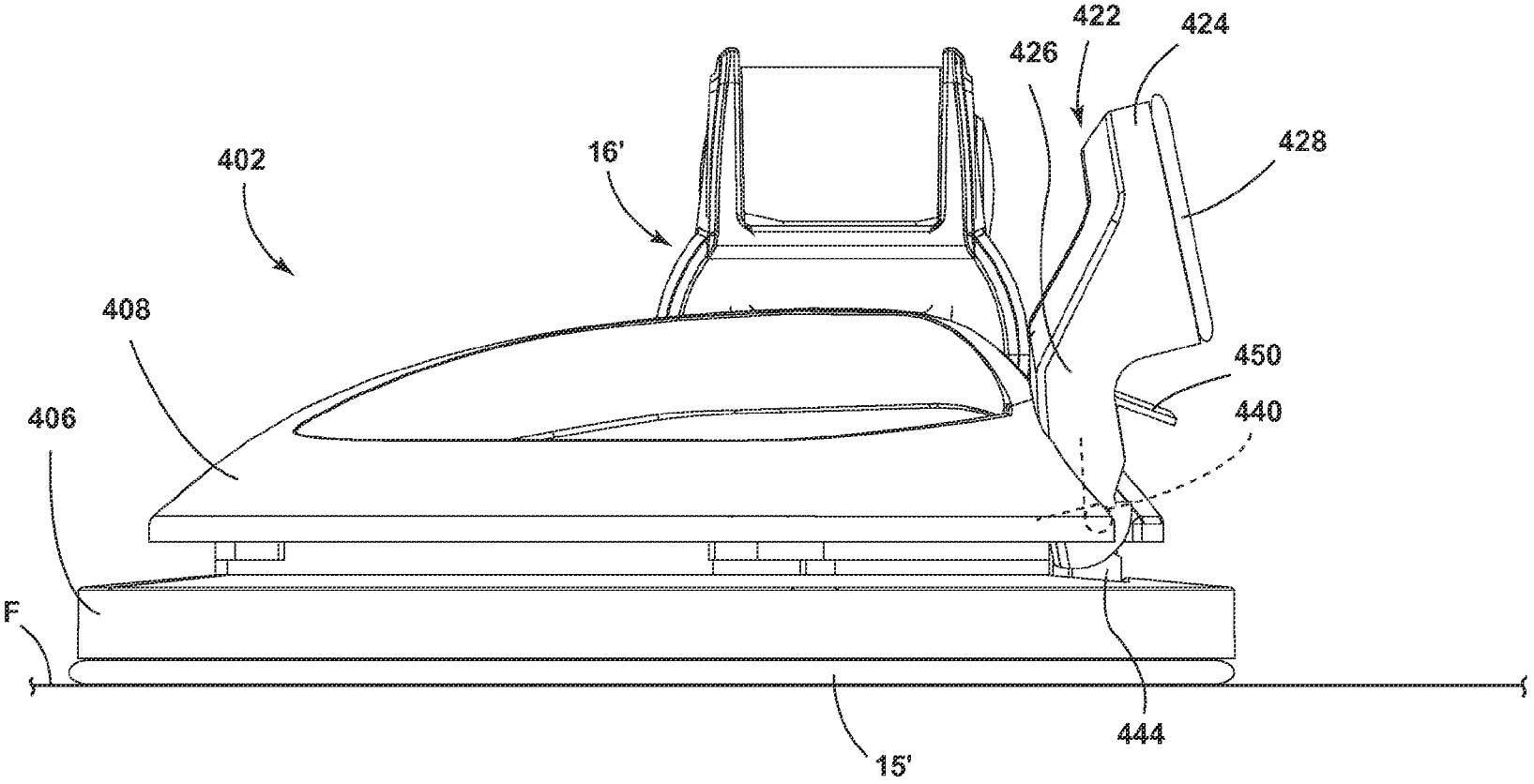
FIG. 16 is a side view of the steam mop of FIG. 11, with the agitator shown in a second position.

The movable agitator assembly 422 can be pivoted between a non-use position as shown in FIG. 16, in which the agitator element 428 is spaced from the surface to be cleaned F, and a use position, as shown in FIGS. 11, 12, 14 and 15, in which the agitator element 428 contacts the surface to be cleaned F. A torsion spring 440 can be mounted around each pivot pin 436 with the free ends being compressed between the support arm 426 and base housing 406 such that the torsion spring 440 is configured to bias the support frame 424 upwardly relative to the base housing 406 toward the non-use position shown in FIG. 16.

Figure 14:
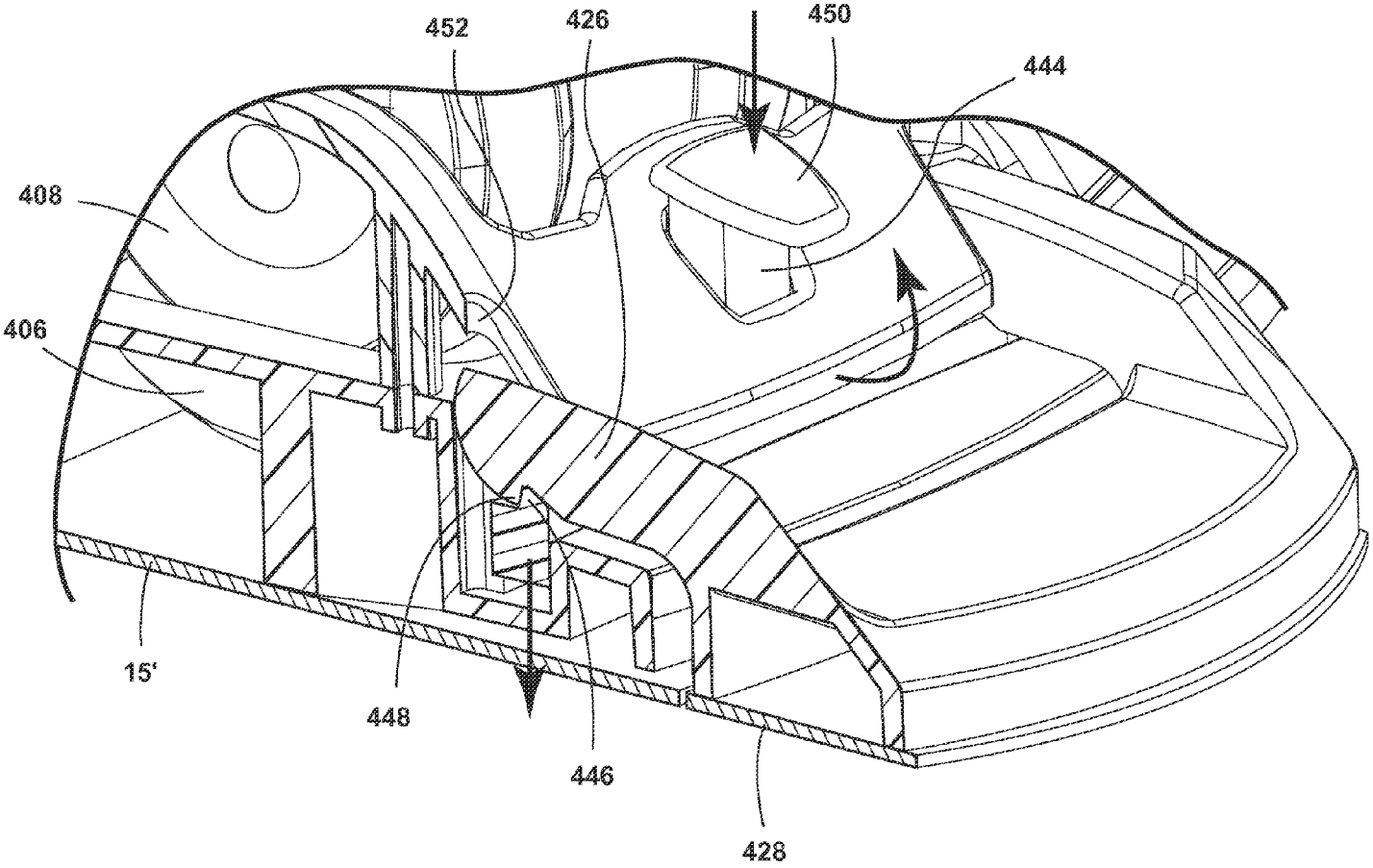
FIG. 14 is a partial cut-away view of the steam mop of FIG. 11 taken along line 14-14, with the agitator shown in a first position.
Figure 15:
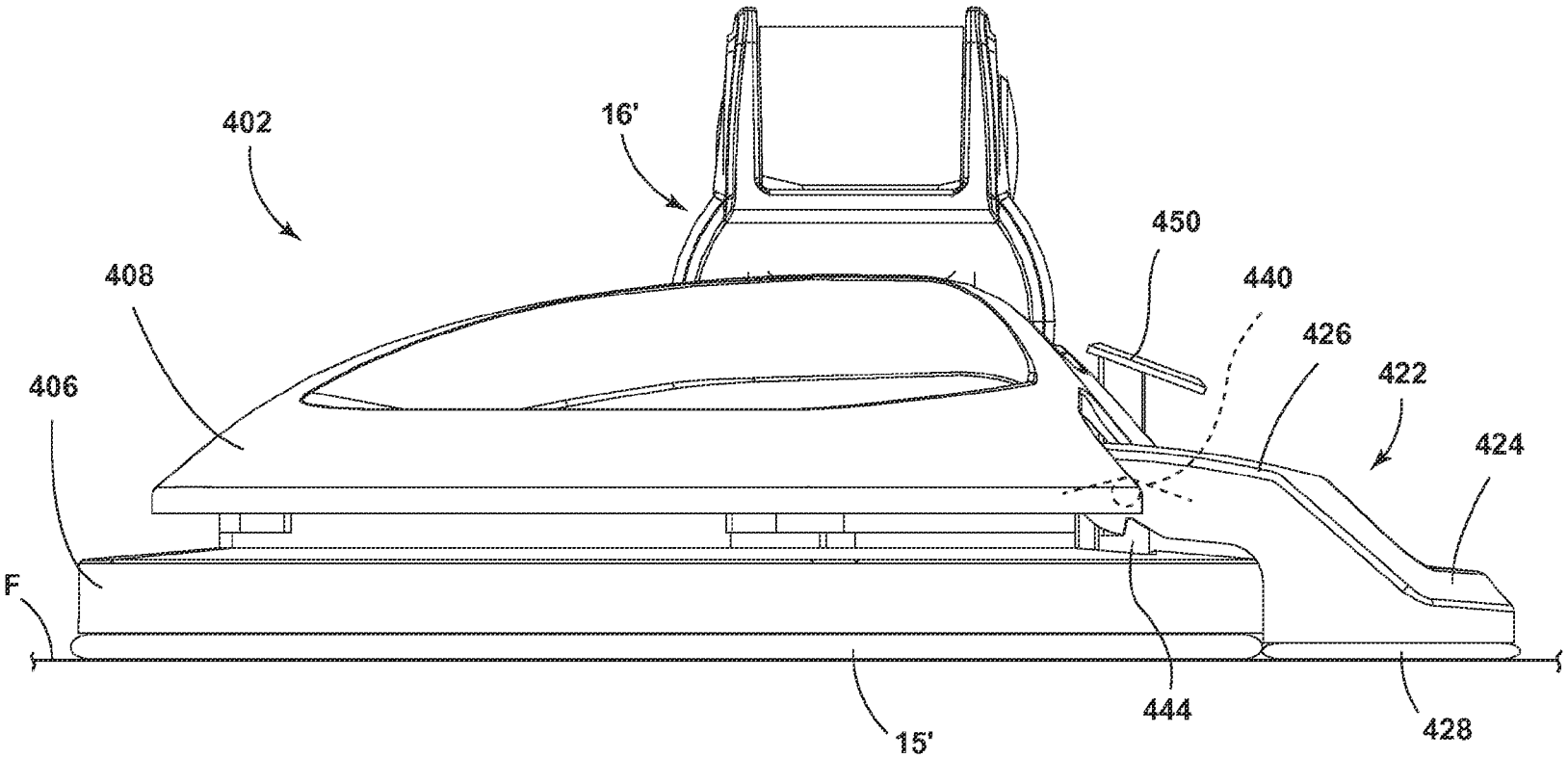
FIG. 15 is a side view of the steam mop of FIG. 11, with the agitator shown in a first position.

The foot assembly 402 can further comprise an actuator assembly 442 for adjusting the position of the movable agitator 422 with respect to the surface to be cleaned. As best shown in FIGS. 13 and 14, a spring-loaded latch 444 can be provided at the rear of the foot assembly 402. The latch 444 slides vertically through an opening in the cover housing 408. The latch 444 further comprises a catch 446 at an upper portion thereof for engaging a hook 448 on the bottom of each support arm 426. A compression spring (not shown) biases the latch 444 upwardly so the catch 446 is forced towards the hook 448. The catch 446 can be disengaged from the hook 448 by depressing a foot pedal 450 on the upper portion of the latch 444, which slides the latch 444 vertically downwardly relative to the surface to be cleaned and moves the catch 446 downwardly away from the hook 448. The torsion spring 440 is then free to push the support arm 426 upwardly, thereby pivoting the support frame 424 and agitator element 428 upwardly to the non-use position, shown in FIG. 16, in which the agitator element 428 is spaced from the surface to be cleaned F.

In the use position, the agitator element 428 is positioned rearwardly of the base housing 406. A user can selectively pivot the agitator element 428 into the use position to clean heavily soiled areas on the surface to be cleaned. With the agitator element 428 in the use position, a user can make one or more reciprocal cleaning strokes to scrub the soiled area. To move the agitator element 428 from the use position to the non-use position, the latch 444 can be pressed downwardly to release the catch 446 from engagement with the hook 448, whereby the support frame 424 and associated agitator element 428 will be forced to pivot upwardly to the non-use position by the torsion spring 440. The support arms 426 pivot about the pivot pins 436 and are rotated about the pivot couplings until the support arms 426 rest against an upper surface of the cover housing 408. A first stop 452 is provided on the cover housing 408, to provide a secure location for the support arms 426 to come to rest against the cover housing 408 in the non-use position. Two spaced second stops 454 are provided on the base housing 406 against which the support arms 426 will rest in the use position. The stops 452, 454 are configured so that when the support frame 424 is in the use position, the bottom of the support frame forces the agitator element 428 against the surface to be cleaned, thereby compressing the agitator element to some extent. The stops 452, 454 prevent damage to the movable agitator assembly 422 and foot assembly 402 when moving between the use and non-use positions.

In operation, the steam mop is prepared for use in substantially the same manner as previously described. Likewise, the function of the steam mop 400 is substantially similar to details previously disclosed herein, with the exception of the steam distribution system, movable agitator assembly 422 and viewing window 412, which will be described hereinafter.

During operation, when a user encounters a heavily soiled area, the user can lock the agitator element 428 and support frame 424 into the use position by manually rotating the support frame 424 downwardly so the pivot pins 436 rotate within the pivot couplings in the spaced brackets 432. The bottom of the support arms 426 eventually contact the second stops 454, which limit the downward rotation of the support frame 424. As the support frame 424 rotates, the torsion spring 440 is compressed between the support arms 426 and the base housing 406. The hooks 448 on the bottom of the support arms 426 engage a catch 446, which locks the support frame 424 in the in use position thereby forcing the agitator element 428 into contact with the surface to be cleaned and compressing the agitator element 428 slightly between the support frame 424 and the surface to be cleaned. A user can then resume reciprocal forward and backward cleaning strokes, applying downward force to the foot assembly 402 and wiping the cleaning pad 15' and scrubbing the agitator element 428 across the surface to be cleaned while selectively distributing steam to the surface to be cleaned. To release the agitator element 428 and support frame 424 from the use-position into the non-use position, the user depresses the foot pedal 450 downwardly, which forces the spring loaded latch 444 downwardly away from hook 448 and releases the catch 446 portion of the latch 444 from the corresponding hook 448 on the support arm 426. The torsion spring 440 forces the support arm 426 upwardly and the support frame 424 rotates about the pivot couplings in the brackets 432 into the non-use position so the agitator element 428 is lifted off the surface to be cleaned F. When the user releases the foot pedal 450, the compression spring (not shown) forces the latch 444 upwardly. When the support frame 424 is in the non-use position, the tops of the support arms contact a first stop 452 on the cover housing 408.

Steam channels (not shown) on the bottom of the base housing 406 are configured to guide steam through an outlet in the distributor nozzle 342', evenly across the base housing to the backside of the cleaning pad 15', including past the translucent viewing windows 412. Accordingly, a user can look through the viewing windows 412 and observe the condensation of the steam vapor while using the steam mop 400 on the surface to be cleaned in addition to easily confirming whether the cleaning pad 15' is in place beneath the base housing 406.

A surface cleaning apparatus, illustrated as a steam mop 500, according to a third embodiment of the invention is shown in FIGS. 17-30. Because many of the components of this embodiment are similar to the previous embodiments, like features are indicated with the same reference numerals. Any of the previously described features can be incorporated into the following embodiment of the invention. The coupling joint 16 swivelably mounts the handle assembly 12 to the foot assembly 14 and is configured to permit the handle assembly 12 to rotate about more than one axis relative to the foot assembly 14 when the handle assembly 12 is in the reclined use position. As shown herein, the coupling joint 16 can comprise a universal or Cardan joint, and can be configured to permit the foot assembly 14 to swivel multi-axially relative to the handle assembly 12. In this embodiment, the coupling joint 16 is configured to rotate back and forth about horizontal axis Z, which extends laterally through the sides of the steam mop 500, and from side to side about axis Y, which is orthogonal to axis Z and extends horizontally from the front to back, through the middle of the steam mop 500. The steam mop 500 differs from the previous embodiments with respect to the supply tank 80 and steam delivery system, the coupling joint 16, the viewing windows 412, and the movable agitator assembly 422, as will be described in greater detail below.

Figure 18:
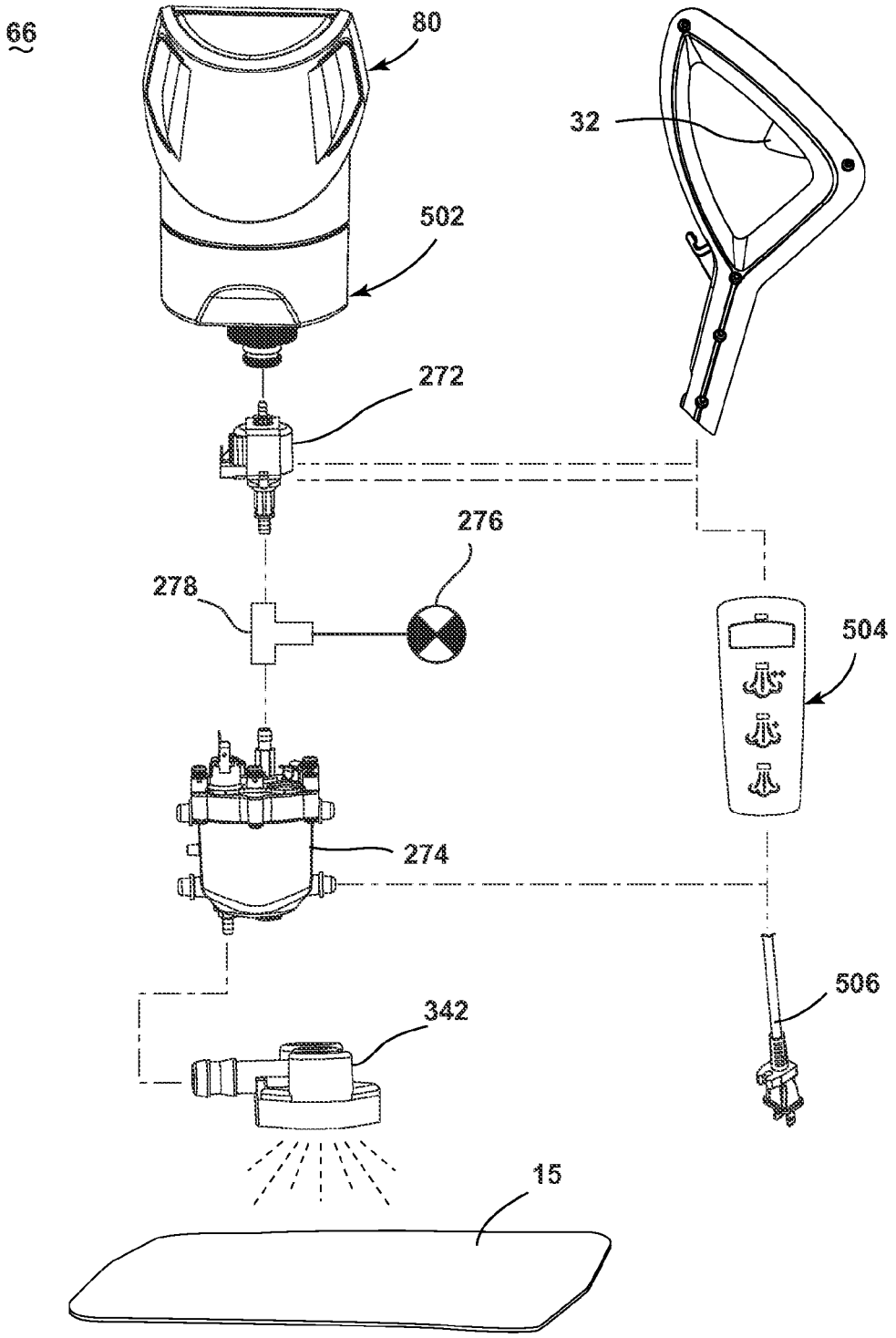
FIG. 18 is a schematic view of a fluid delivery system of the steam mop of FIG. 17.

FIG. 18 is a schematic view of a steam delivery system 66 for the steam mop 500. The steam delivery system 66 can be substantially similar to the steam distribution system 66 described for the second embodiment, with the exception of a filter assembly 502, as described in greater detail below. The steam delivery system 66 includes a steam generator 274 producing steam from liquid, at least one supply tank 80 for storing a supply of liquid, a filter assembly 502 for filtering the liquid passing out of the supply tank 80 to prevent foreign particulates and debris from entering the steam generator 274, a flow controller 272 for controlling the flow of liquid between the supply tank 80 and the steam generator 274, a distributor nozzle 342 in fluid communication with e steam generator 274 for delivering steam to the surface to be cleaned.

The liquid in the supply tank 80 can comprise one or more of any suitable cleaning liquids, including, but not limited to, water, compositions, concentrated detergent, diluted detergent, etc., and mixtures thereof. For example, the liquid can comprise a mixture of water and concentrated detergent. The steam delivery system 66 can further include multiple supply tanks, such as one tank containing water and another tank containing a cleaning agent as described above for the first embodiment.

The flow controller 272 can comprise a pump which distributes liquid from the supply tank 80 to the steam generator 274. An actuator, such as the trigger 32, can be provided to actuate the pump 272 and dispense liquid to the steam generator 274. The trigger 32 can be operably coupled to the pump 272 such that pressing the trigger 32 will activate the pump 272. The pump 272 can be electrically actuated, such as by providing electrical switch between the pump and a power source that is selectively closed when the trigger 32 is actuated, thereby activating the pump 272. In use, the generated steam is pushed out of the outlet of the steam generator 274 by pressure generated within the steam generator 274 and, optionally, by pressure generated by the pump 272. The steam flows out of the distributor nozzle 342 to the cleaning pad 15.

A controller 504 having a user interface may be operably coupled with various components of the steam mop 500, such as the steam generator 274 and/or pump 272, to implement one or more cycles of operation, such as, but not limited to, light steam distribution, medium steam distribution, and heavy steam distribution. The user interface may include operational controls such as dials, lights, switches, and displays enabling a user to input commands, such as a cycle of operation, to the controller and receive information. The steam generator 274, pump 272, and controller 504 can be electrically coupled to a power source, such as a power cord 506 plugged into a household electrical outlet.

Figure 19:
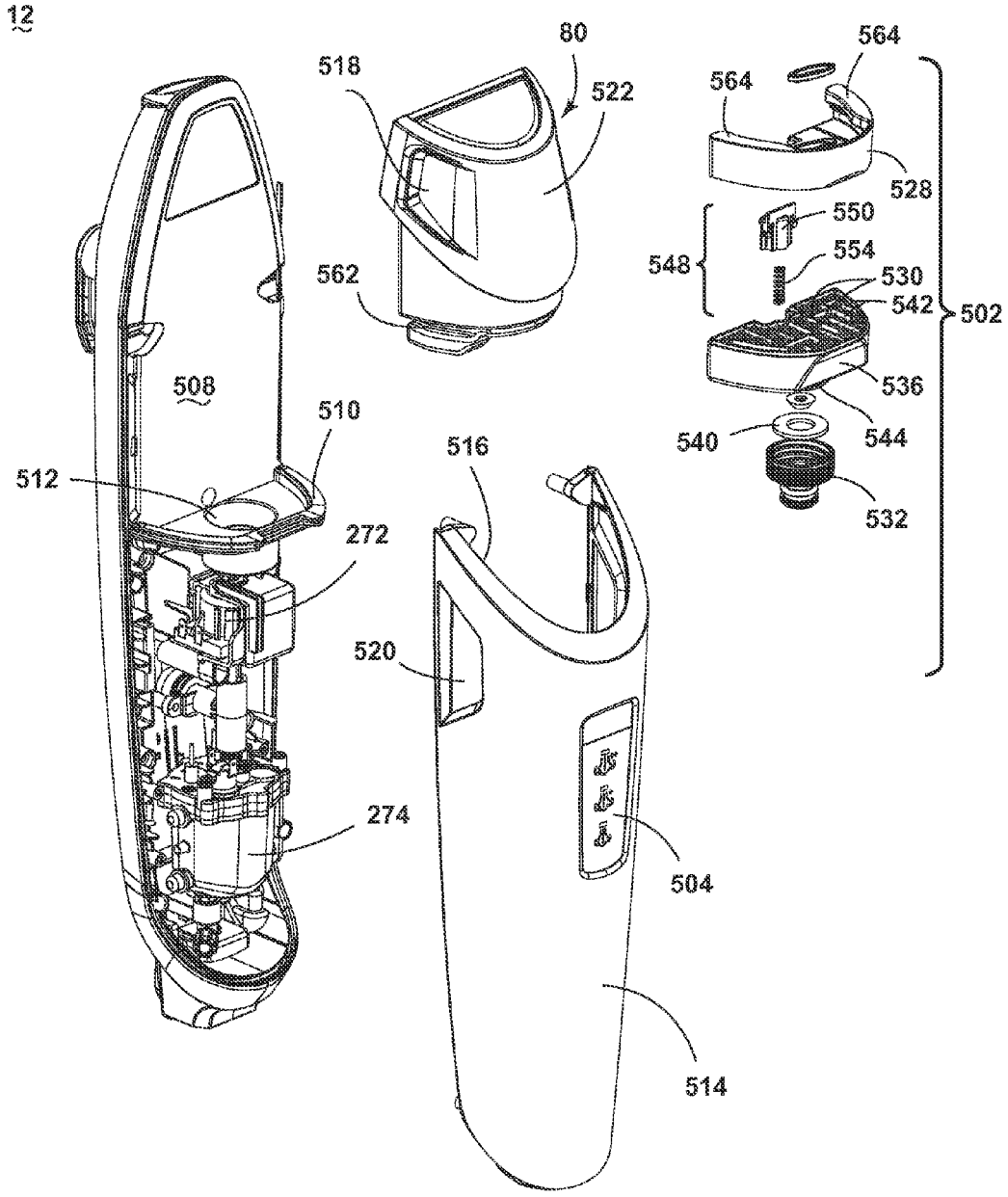
FIG. 19 is a partially exploded view of an upper handle assembly of the steam mop of FIG. 17.

FIG. 19 is a partially exploded view of the upper handle assembly 12. The filter assembly 502 can be incorporated with the supply tank 80, such that the two are removable as one unit from the steam mop 500. The steam mop 500 comprises a tank receiver 508 for receiving the supply tank 80 and filter assembly 502. The tank receiver 508 a platform 510 having a valve seat 512 for fluidly coupling with the supply tank 80 and filter assembly 502 with the steam delivery system 66 (FIG. 18) when seated within the tank receiver 508. The tank receiver 508 can further be defined by a front cover 514 of the steam mop 500, which forms a pocket 516 for insertion supply tank 80 and filter assembly 502. Hand grips 518 can be provided on the supply tank 80 for aiding the user in lifting the supply tank 80 and filter assembly 502 as a unit away from the steam mop 10. The front cover 514 includes cut outs 520 through which a portion of the supply tank 80 is visible, which permits a user to easily ascertain the liquid fill level inside the supply tank 80.

Figure 20:
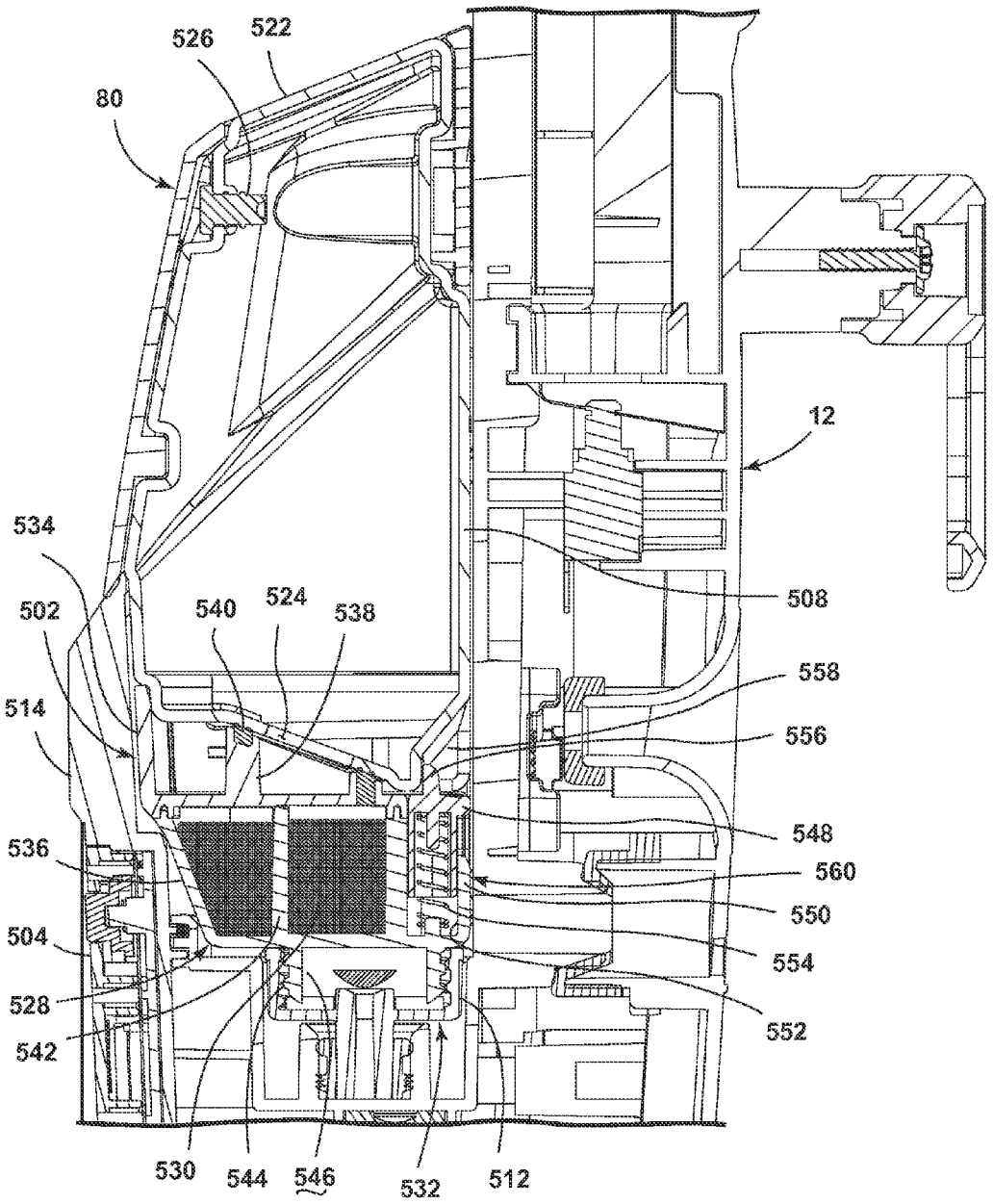
FIG. 20 is a cross-sectional view through line 20-20 of the steam mop of FIG. 17.

FIG. 20 is a cross-sectional view through the supply tank 80 and filter assembly 502. The supply tank 80 comprises a tank body 522 having an outlet port 524 on the bottom of the tank body 522. The outlet port 524 can also act as a fill inlet for the supply tank 80 when the supply tank 80 is removed from the handle assembly 12 for filling. A bleeder valve 526 is provided on the tank body 522 and is adapted to vent ambient atmospheric air into the tank body 522 when liquid inside the supply tank 80 is dispensed during use. At least a portion of the supply tank 80 can be formed of a transparent or tinted translucent material, which permits a user to view the contents of the supply tank 80.

The filter assembly 502 comprises a filter housing 528 removably mounted to the bottom of the supply tank 80, a filtration medium 530 provided in the filter housing 528, and a valve assembly 532. The filter housing 528 can include an upper casing 534 and a lower casing 536 which together define a chamber in which the filtration medium 530 is received. The upper casing 534 has an inlet port 538 adapted to mate with the outlet port 534 of the supply tank 80. A seal 540 can be positioned between the ports 524, 538 to seal the interface therebetween when the filter assembly 502 is mounted to the supply tank 80.

The filtration medium 530 can comprise a granular substance such as a mixed bed ion exchange resin or polymer, which can further comprise cross-linked polystyrene beads, for example, that are configured to purify and decontaminate liquid from the supply tank 80. Accordingly, the lower casing 536 may be provided with a plurality of internal walls 542 that form a frame work for holding the filtration medium 530 and which can provide a labyrinthine structure for liquid from the supply tank 80 to pass through.

The lower casing 536 can further include a lower surface adapted to rest on the platform 510 and a hollow neck 544 protruding from the lower surface that defines an outlet 546 of the filter assembly 502 which receives the valve assembly 532. The valve assembly 532 is adapted to move to a closed position to seal the outlet 546 of the filter assembly 502 when the supply tank 80 is removed from the steam mop 500. When the supply tank 80 and filter assembly 502 are seated in the tank receiver 508, the neck 544 is at least partially received within the valve seat 512 and the valve assembly 532 is adapted to automatically move to an open position to open the outlet 546 of the filter assembly 502.

A filter latch 548 selectively latches the filter assembly 502 to the supply tank 80 and can comprise a latch body 550 that is slidably mounted with a latch cavity 552 formed in the rear of the filter housing 528 and a spring 554 biasing the latch 548 toward a closed position shown in FIG. 20. The latch body 550 includes an upper latching tab 556 which is selectively received by a latch receiver 558 formed in the rear of the tank body 522, and a user-engageable lever 560 for selectively actuating the filter latch 548. With the supply tank 80 and filter assembly 502 removed from the steam mop 500 as a unit, by pressing down on the lever 560, the latching tab 556 moves out of the latch receiver 558, allowing the filter housing 528 to be slid forwardly and off the supply tank 80. As shown in FIG. 19, the supply tank 80 has recessed grooves 562 formed in the tank body 522 for receiving corresponding rails 564 on the filter housing 528 to slidably mount the filter assembly 502 to the bottom of the supply tank. 80.

Figure 21:
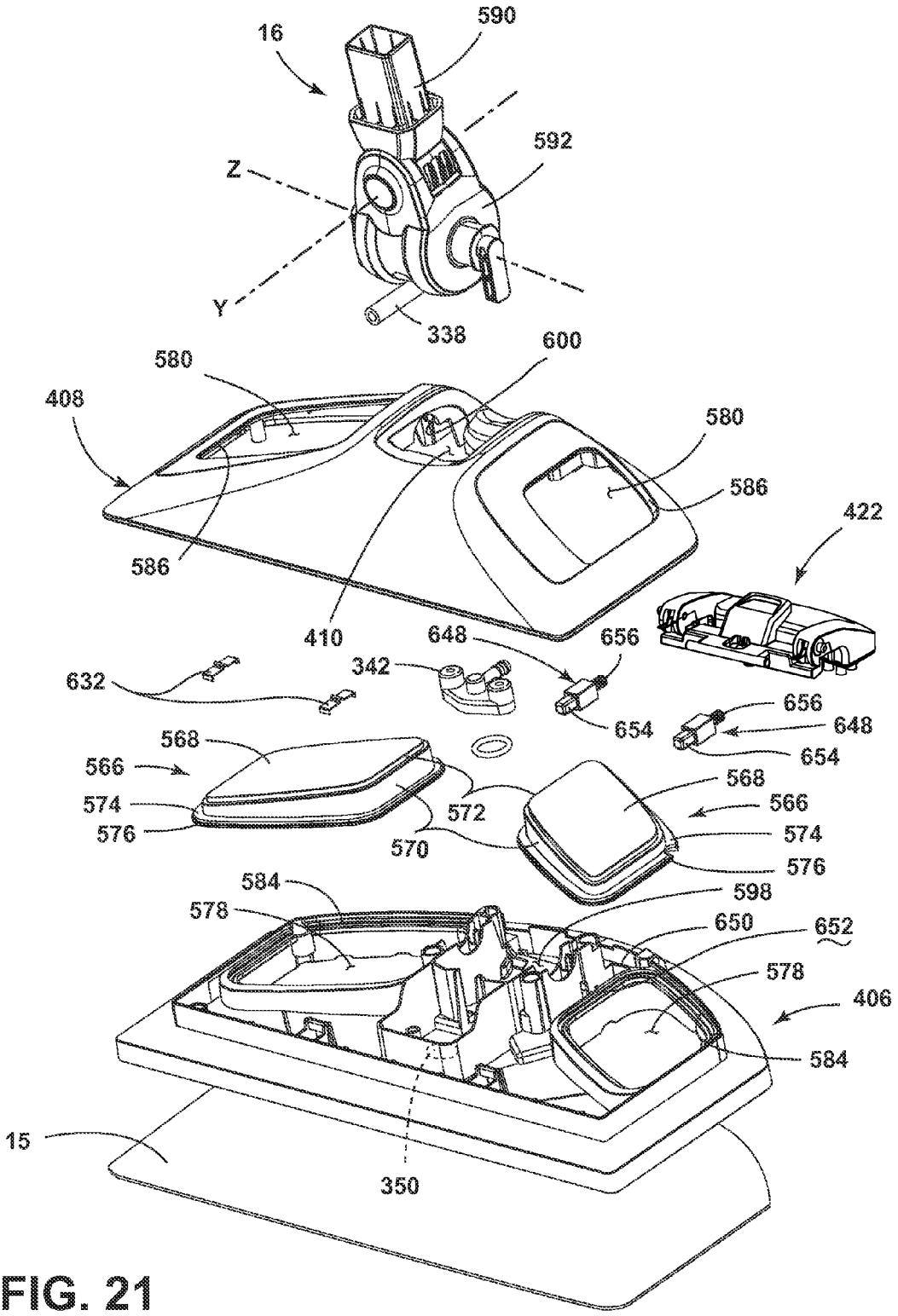
FIG. 21 is an exploded view of a foot assembly of the steam mop of FIG. 17.

FIG. 21 is an exploded view of the foot assembly 14. As in the second embodiment, the foot assembly 14 includes a base housing 406 and a cover housing 408 attached to the base housing 406 via fasteners (not shown). The foot assembly 14 is further provided with one or more viewing windows 412 which allow the user to view the cleaning pad 15 without having to flip the foot assembly 14 over. In the present embodiment, the viewing windows 412 are provided as light transmissive window panes 566 mounted to the foot assembly 14. Each window pane has a top wall 568 and a peripheral side wall 570, with at least the top wall 568 being formed of a light transmissive material. The top wall 568 has an upper peripheral ledge 572 and the side wall 570 includes an outwardly extending flange 574 having a lower peripheral ledge 576 along the outer edge of the flange 574.

The housings 406, 408 are provided with aligned window cutouts 578, 580, respectively, and the window panes 566 are mounted between the housings 406, 408 at the cutouts 578, 580. The cutout 578 on the base housing 406 has a groove 584 that extends around the perimeter of the cutout 578. The lower ledge 576 of the window pane 566 is seated in the groove 584 to retain the window pane 566 on the base housing 406. The cutout 580 on the cover housing 408 has a downwardly-depending rim 586 which engages the upper ledge 572 on the top wall 568 of the window pane 566.

The distributor nozzle 342 is aligned with an aperture 350 on the base housing 406. Various steam channels (not shown) on the bottom of the base housing 406 are configured to guide steam from the distributor nozzle 342, evenly across the base housing 406, and past the viewing windows 412. Accordingly, a user can look through the viewing windows 412 observe the condensation of the steam vapor while using the steam mop 500 on the surface to be cleaned. Moreover, a user can easily confirm whether a cleaning pad 15 is installed beneath the base housing 406 prior to using the steam mop 500.

The coupling joint 16 comprises an upper handle connector 590 and a lower foot connector 592, and can accommodate a fluid conduit 338 which extends through the coupling joint to the distributor nozzle 342. The foot assembly 14 comprises a cradle formed by mating cradle halves 598, 600 formed in the base housing 406 and the cover housing 408 for accommodating the coupling joint 16. The upper handle connector 590 pivotally couples with the lower foot connector 592 and defines the second axis of rotation Y about which the foot assembly 14 can rotate. The foot connector 592 in turn pivotally couples with the foot assembly 14 and defines the first axis of rotation Z about which the foot assembly 14 can rotate.

Figure 17:
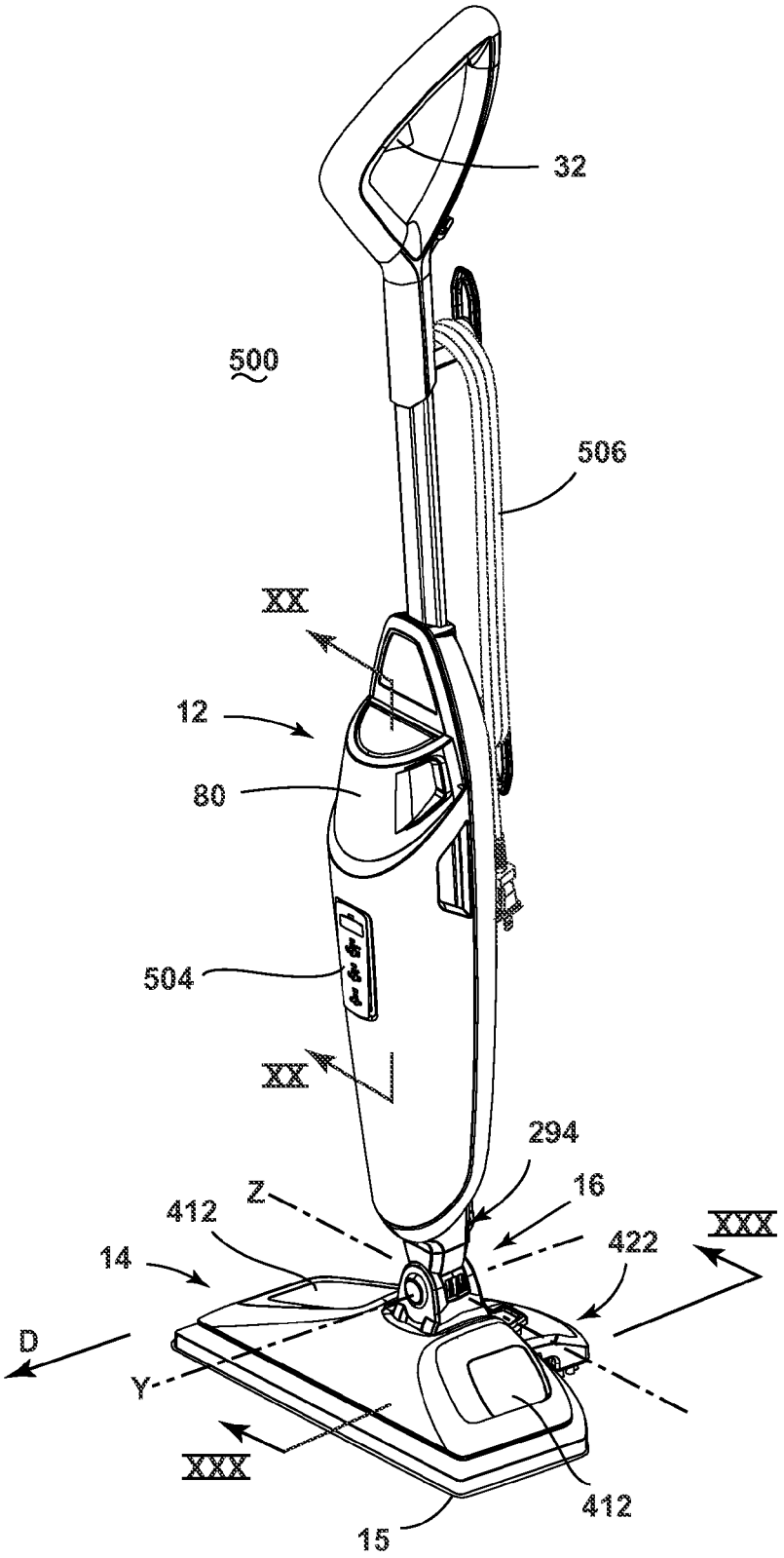
FIG. 17 is a front perspective view of a surface cleaning apparatus in the form of a steam mop according to a third embodiment of the invention.
Figure 22:
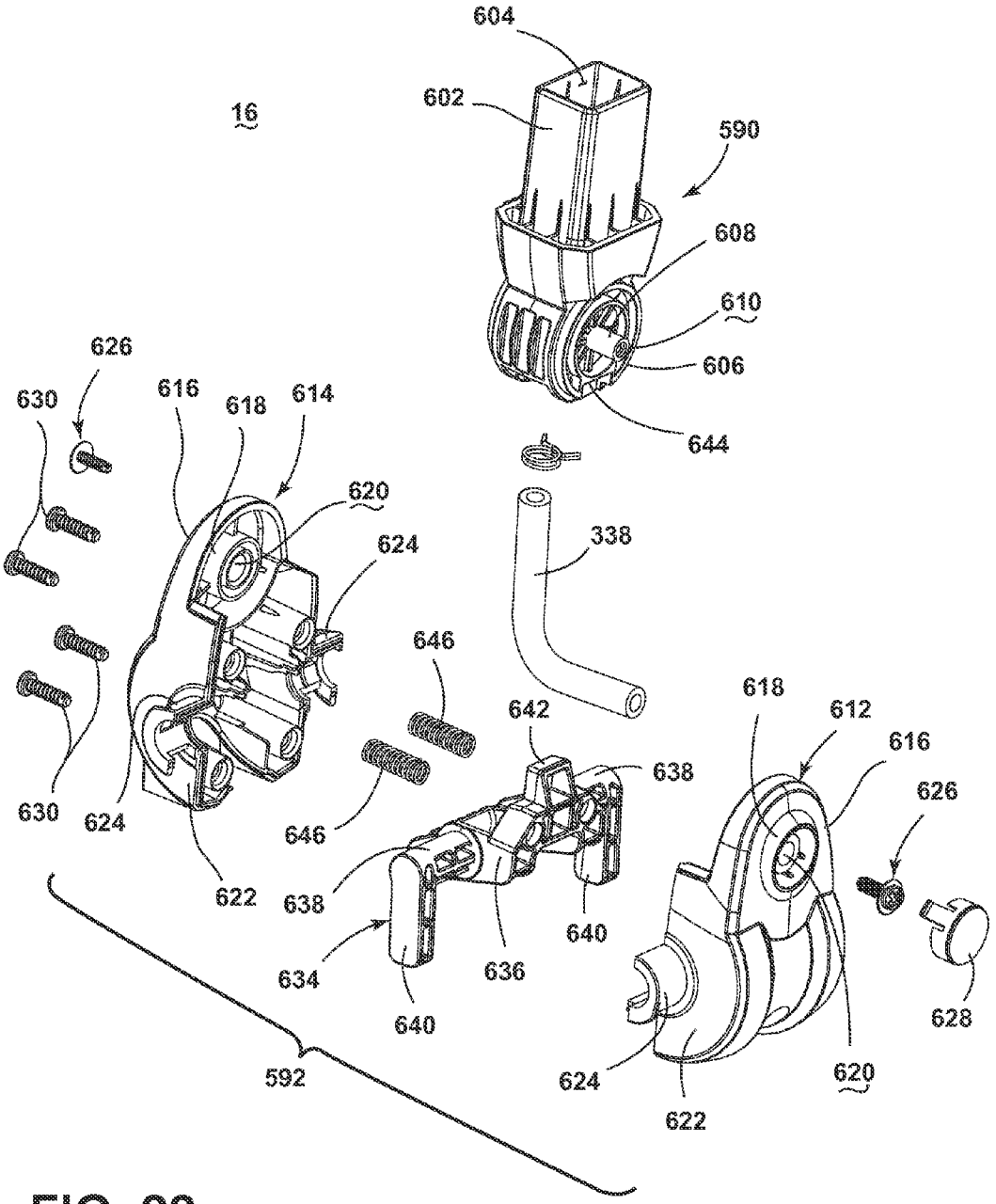
FIG. 22 is an exploded view of a coupling joint of the steam mop of FIG. 17.

FIG. 22 is an exploded view of the coupling joint 16. The handle connector 590 comprises an upper tubular portion 602 which defines a socket 604 which slidably receives the lower neck portion 284 of the handle assembly 12 (FIG. 17). A lower pivot portion 606 extends downwardly from the tubular portion 602 and has aligned pivot arms 608 protruding from the front and rear of the pivot portion 606 and having blind holes 610 formed therein.

The foot connector 592 comprises front and rear holders 612, 614 which can be mirror images of each other, in general. Each holder 612, 614 comprises an upper extension 616 with an outwardly facing receiver 618 having a bore 620 formed therethrough. Each holder 612, 614 further comprises a lower extension 622 that depends from the upper extension 616. The lower extensions 622 are curved in opposing directions, and mate together to form pivot arms 624 which are rotatably received in the corresponding cradle 598, 600 formed in the foot assembly 14 (FIG. 21). Detent springs 632 can be mounted in the cradle 598 for engaging detent slots (not shown) in the bottom of the pivot arms 624 for retaining the handle connector 16 in an upright, storage position.

The foot connector 592 can be coupled to the handle connector 590 by sliding the bores 620 on the front and rear holders 612, 614 over the pivot arms 608 of the handle connector 590, and securing the connectors 590, 592 together using one or more fasteners 626. The bores 610 in the pivot arms 608 receive the fasteners 626. A cap 628 can be fitted over the front fastener 626 to hide the front fastener 626 from view. Additional fasteners 630 can be provided for coupling the front and rear holders 612, 614 together.

The coupling joint 16 can be provided with a detent mechanism for selectively preventing the coupling joint 16 from rotating side-to-side, such as when the steam mop 500 is in a stored position (shown in FIG. 17). The detent mechanism can include a detent bar 634 mounted within the coupling joint 16, which comprises a central frame 636 with two pivot shafts 638 protruding outwardly from the central frame 636. Stop arms 640 protrude downwardly from the pivot shafts 638. A detent protrusion 642 extends upwardly from the central frame 636. The detent bar 634 is received between the front and rear holders 612, 614, with the pivot shafts 638 positioned in the space between the lower extensions 622 and the stop arms 638 extending out of the pivot arms 624. The bottom of the handle connector 590 is provided with a detent 644 which receives the detent protrusion 642 on the detent bar 634 when the steam mop 500 is in a stored position. Springs 646 are positioned between the central frame 636 and the rear holder 614 to bias the detent protrusion 642 away from the detent 644.

Referring to FIG. 21, in additional to the detent bar 634, the detent mechanism comprises spring-biased stops 648 mounted within the housings 406, 408 of the foot assembly 14. The base housing 406 can be provided with pockets 650 for receiving the stops 648, with a slot 652 formed in a forward end of each pocket 650 for allowing a nose 654 of the corresponding stop 648 to slide forwardly and rearwardly. A spring 656 is received in the pocket 650 and biases the stop 648 forwardly so that the nose 654 protrudes through the slot 652.

Figure 23:
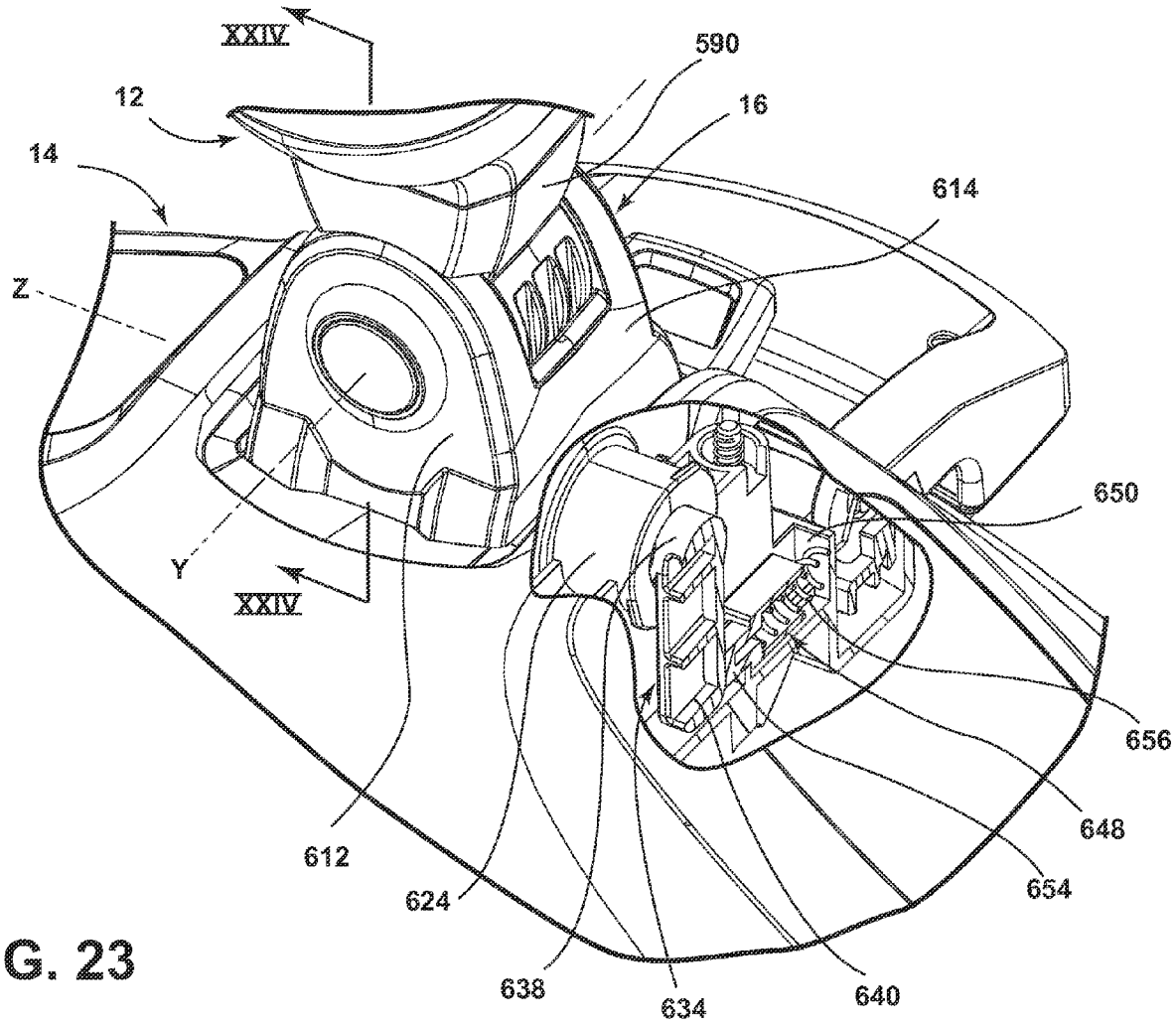
FIG. 23 is a partial cut-away view of the foot assembly of FIG. 21, showing the coupling joint in an upright position.
Figure 24:
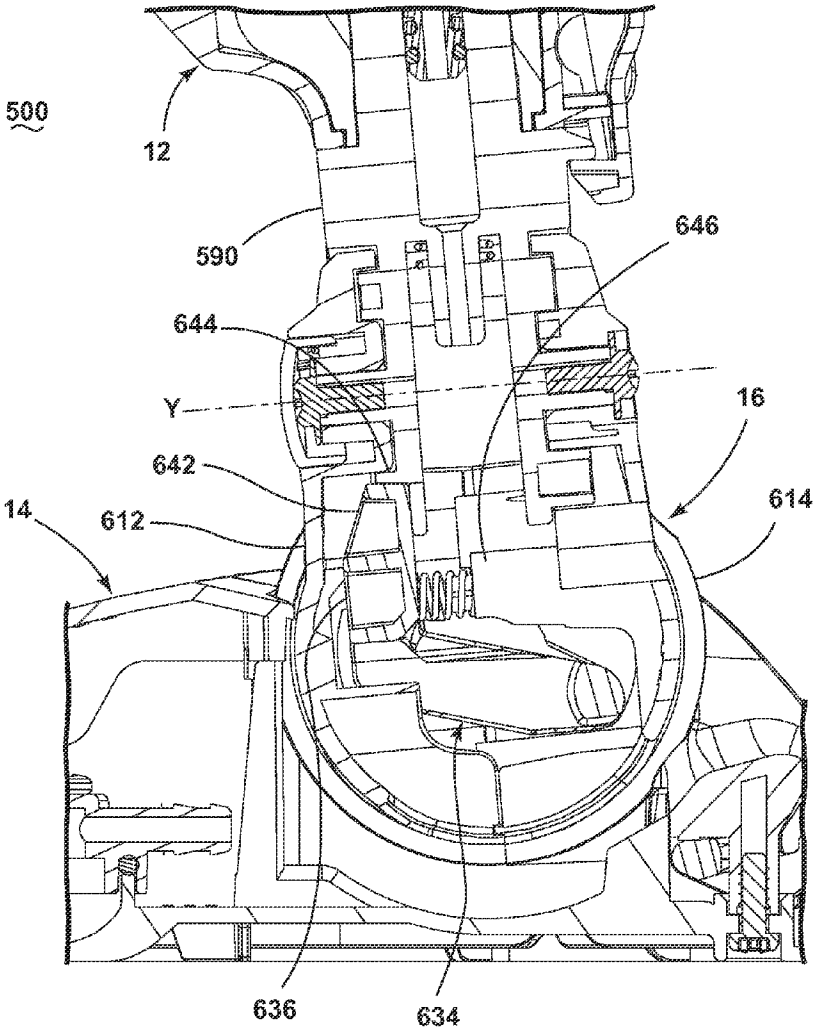
FIG. 24 is a cross-sectional view through line 24-24 of the steam mop of FIG. 23, showing the coupling joint in an upright position.
Figure 25:
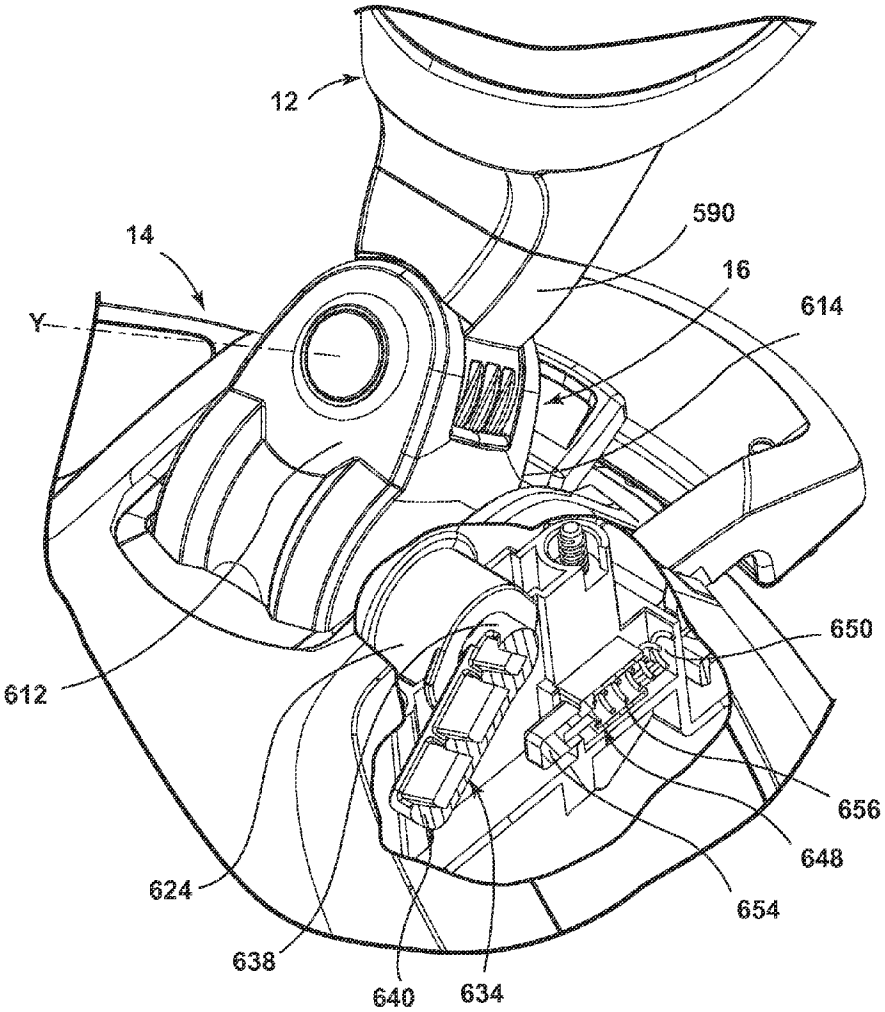
FIG. 25 is a partial cut-away view similar to FIG. 23, showing the coupling joint in a reclined position.
Figure 26:
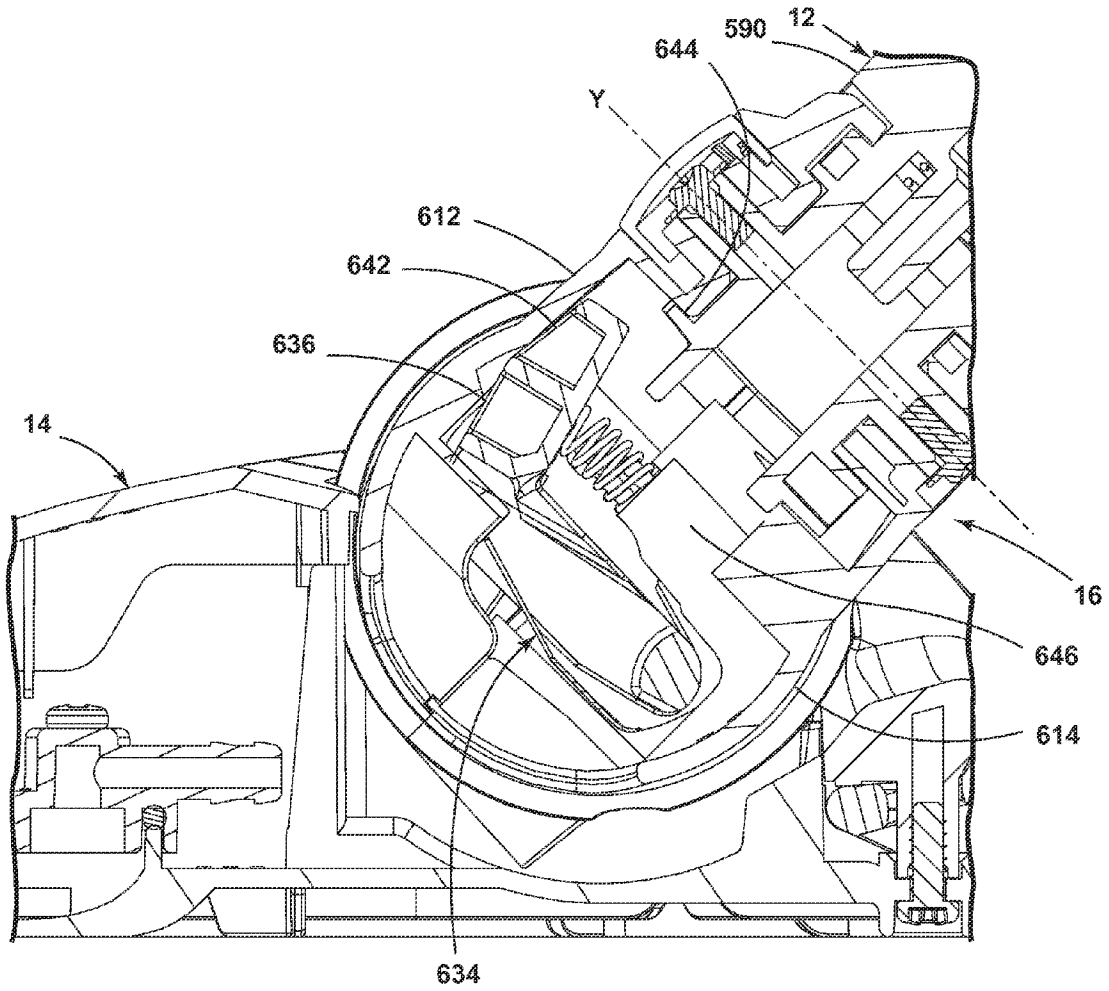
FIG. 26 is a cross-sectional view similar to FIG. 24, showing the coupling joint in a reclined position.

FIG. 23-26 illustrate the movement of the coupling joint 16 between an upright storage position and a reclined use position. The coupling joint 16 enables the steam mop 500 to move between the upright storage position, shown in FIGS. 23 and 24, and the reclined use position, one example of which is shown in FIGS. 25 and 26. In the reclined use position, the handle assembly 12 can be moved about the axis Z and Y of the coupling joint 16. The detent mechanism selectively prevents the handle assembly 12 from rotating side-to-side when the handle assembly 12 is in the storage position. However, the detent mechanism is also configured with a cushion or override feature that allows the handle assembly 12 to rotate from side-to-side even if the detent protrusion 642 is locked in the detent 644 to prevent side-to-side movement, but only when an excessive side load or impact is applied to the handle assembly 12 or foot assembly 14, for example. The override feature can prevent breakage or damage of the coupling joint 16, handle assembly 12 and foot 14.

In the reclined use position shown in FIGS. 25 and 26, the coupling joint 16 is rotated rearwardly about axis Z with respect to the foot assembly 14 or clockwise as shown in the orientation of FIG. 26. The coupling joint 16 initially rotates around the stationary detent bar 634, which draws the detent 644 in the handle connector 590 away from the detent protrusion 642 on the detent bar 634, thereby allowing the handle connector 590 to rotate side-to-side about axis Y. During this time, the detent bar 634 remains essentially stationary, since the stop arms 640 are engaged with the stops 648 in the foot 14.

When the coupling joint 16 reaches a predetermined angle of recline, the inner surface of the front holder 612 contacts the central frame 636 on the detent bar 634 and forces the detent bar 634 to rotate clockwise with the coupling joint 16 about the pivot shafts 638 while compressing the springs 646 slightly. Though compressed, the springs 646 push the detent protrusion 642 away from the detent 644 and thus prevent the detent protrusion 642 from inadvertently re-engaging the detent 644 when the handle is reclined. The clockwise rotation of the detent bar 634 while engaged with the front holder 612 also draws the stop arms 640 away from the stops 648.

To return the handle assembly 12 to the upright storage position, shown in FIGS. 23 and 24, the coupling joint 16 is rotated forwardly about axis Z with respect to the foot assembly 14 or counterclockwise as shown in the orientation of FIG. 24. The initial rotation of the coupling joint 16 immediately draws the front holder 612 away from the central frame 636, which leaves the detent bar 634 free to rotate counterclockwise under the biasing influence of the springs 646. This brings the stop arms 640 on the detent bar 634 into engagement with the stops 648 in the foot assembly 14 and temporarily holds the detent bar 634 in place. Further rotation of the coupling joint 16 brings the detent 644 in the handle connector 590 into engagement with the detent protrusion 642 on the detent bar 634. The final engagement of the handle connector 590 with the detent bar 634 can rotate the detent bar 634 further about the pivot shafts 638, which will partially depress the stops 648 by partially compressing the springs 656.

The partially depressed stops 648 and springs 656 provide a cushion or override feature that allows the detent mechanism to be overridden if a side load or impact load is applied to the handle assembly 12 or foot assembly 14 that exceeds a predetermined value. For example, if the steam mop 500 is dropped on an edge of the foot assembly 14 or is knocked over onto the handle assembly 12, the override feature permits the detent protrusion 642 to be forced out of the detent 644, which frees the handle assembly 12 to rotate side-to-side from an upright detented position, which can prevent breakage or damage of the coupling joint 16, handle assembly 12 and foot 14. In a situation where the detent mechanism is overridden, a force or impact is applied to the handle assembly 12, for example, that urges the handle connector 590 to rotate side-to-side about the Y axis and the detent protrusion 642 is forced against the side of the detent 644. If the force or impact exceeds a pre-determined value, the detent protrusion 642 will slide out of the detent 644 recess because the cushion or override feature allows the detent bar 634 to flex or rotate forwardly about the Z axis, or counter-clockwise as shown in FIG. 26 to release the detent protrusion 642 from the detent 644. As the detent bar 634 rotates, the stop arms 640 further depress the stops 648 and springs 656 rearwardly into the pocket 650 from a previously partially depressed position. The stops 648 move rearwardly to a position that allows the detent bar 634 to rotate forwardly and permit the protrusion 642 to slide out of the detent 644, thereby freeing the upright detented handle assembly 12 to rotate from side-to-side.

Figure 27:
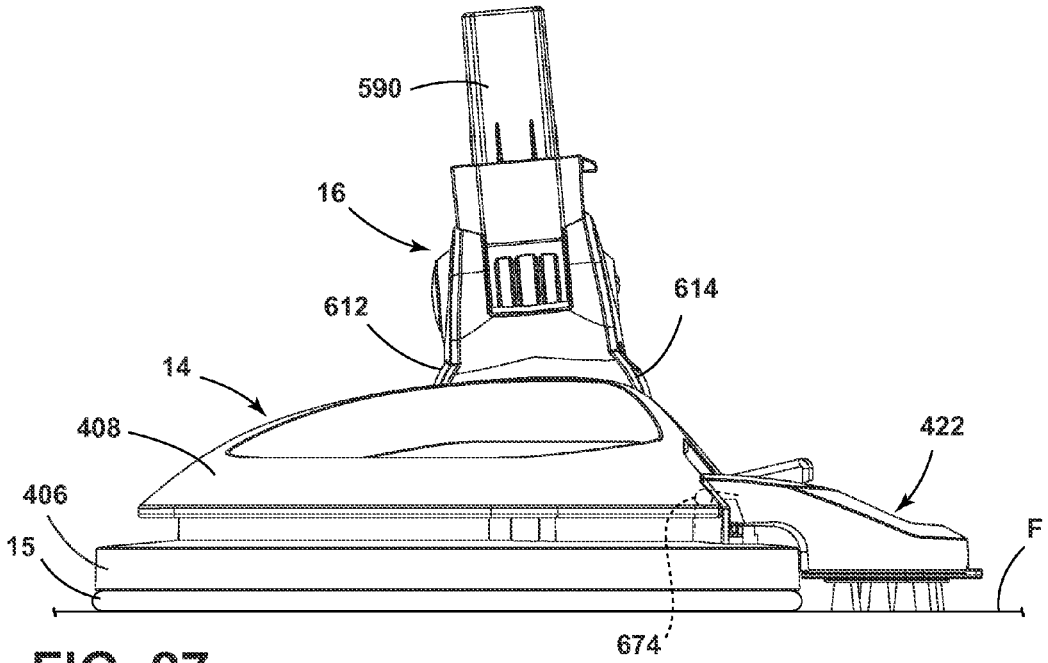
FIG. 27 is a side view of the steam mop of FIG. 17, with an agitator assembly shown in a first use position.
Figure 28:
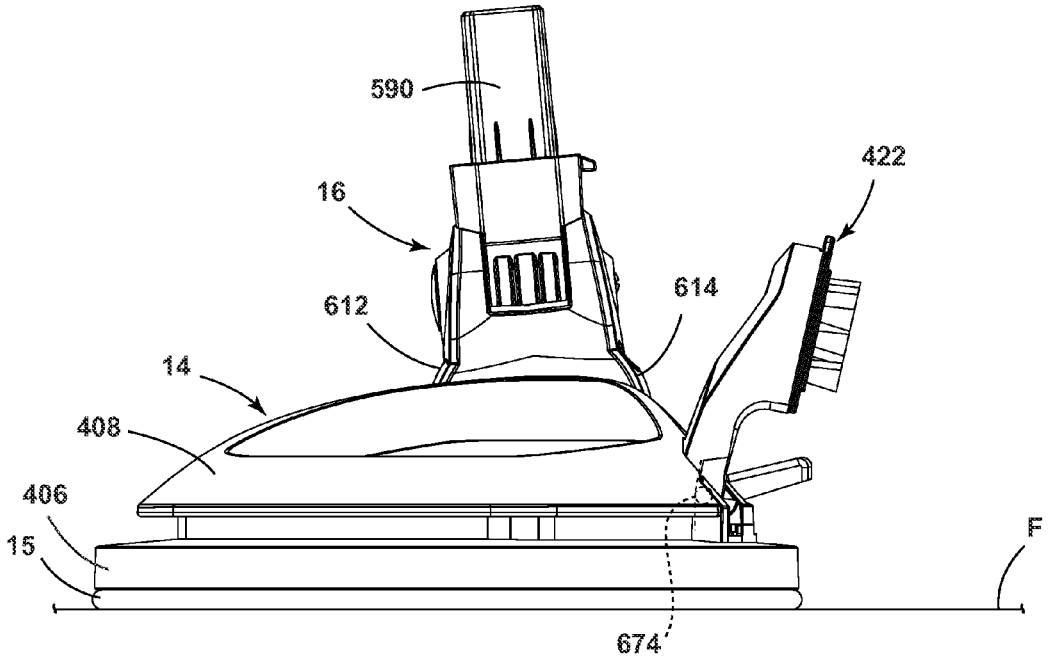
FIG. 28 is a view similar to FIG. 27, with the agitator assembly shown in a second non-use position.

FIG. 27-28 illustrate the movement of the agitator assembly 422 between a first use position and a second non-use position. The movable agitator assembly 422 is provided on a rear portion of the foot assembly 14 is configured for movement between a first position shown in FIG. 27 and a second position shown in FIG. 28. In the first position, the agitator assembly 422 is in a use position and contacts the surface to be cleaned F to provide enhanced, localized agitation of the surface to be cleaned whereas, in the second position, the agitator assembly 422 is in a non-use position and does not contact the surface to be cleaned F.

Figure 29:
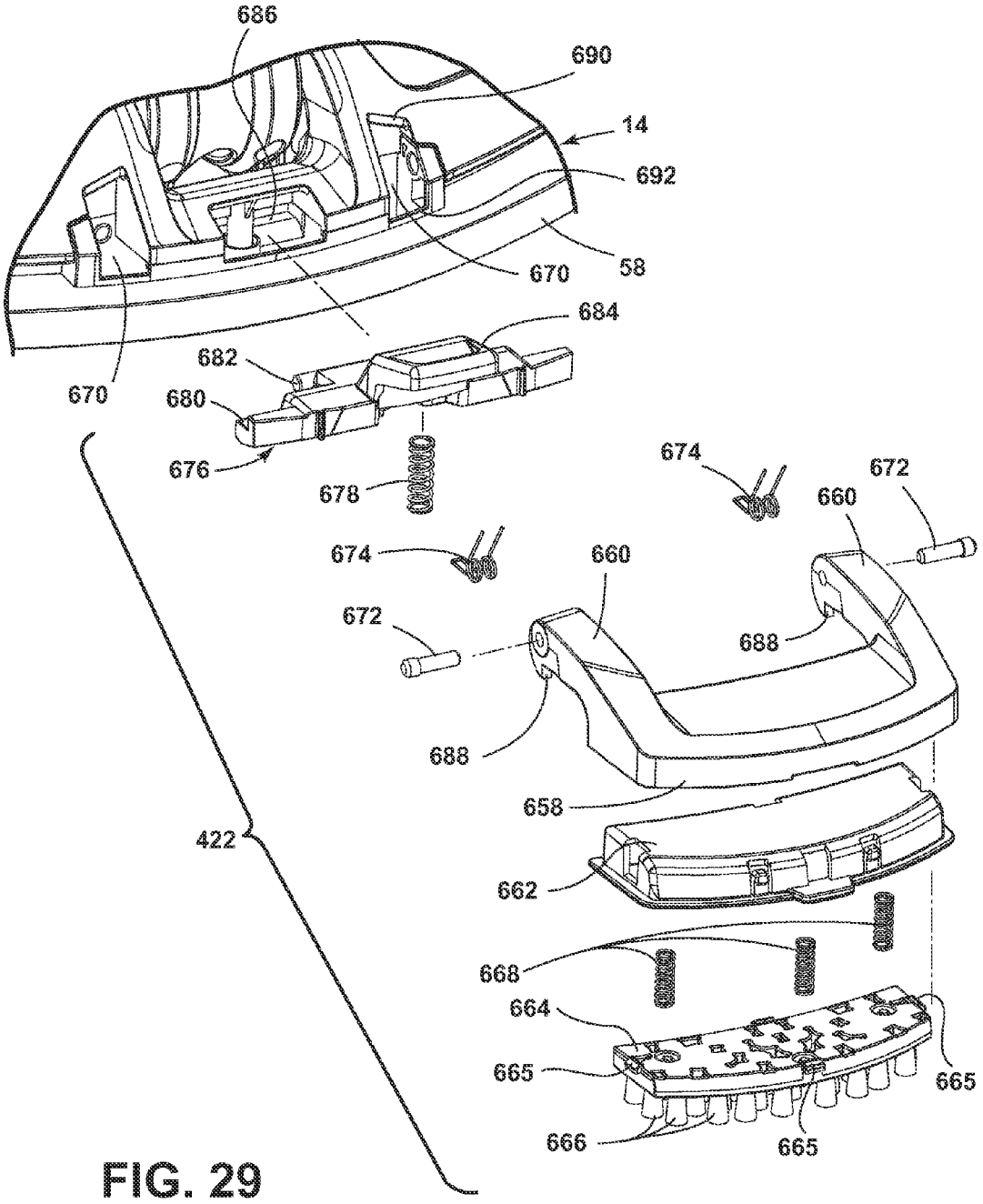
FIG. 29 is an exploded view of the agitator assembly of FIG. 27.

FIG. 29 is an exploded view of the agitator assembly 422. The agitator assembly 422 comprises an agitator support frame 658 with support arms 660 extending perpendicularly from the ends thereof. A cavity 662 is provided in the bottom of the support frame 658 and is adapted to receive a floating plate 664 that is configured to automatically adjust to different floor surface features, carpet pile heights, etc. An agitator element 666 is coupled to the bottom of the plate 664 and is separate from the cleaning pad 15. The agitator element 666 can comprise a variety of materials that are configured to agitate the surface to be cleaned; as shown herein, the agitator element 666 comprises a plurality of bristles projecting from the bottom of the plate 664. The plate 664 can include retention features for detachably retaining the plate 664 to the cavity 662. The retention features have been illustrated as snaps 665 around the perimeter of the plate 664 for engaging a retainer rim (not shown) inside the cavity 662. Thus, the plate 664 and associated agitator element 666 can be removed from the cavity 662 for cleaning, replacement or for exchanging they type of agitator element 666 by pulling the plate 664 downwardly, which forces the snaps 665 around the lip (not shown) and releases the plate 664 from the cavity 662. Alternatively, separable fasteners (not shown) such as hook and loop fasteners, for example, can be configured to detachably secure an agitator element 666 to the support frame 658. Alternatively, the agitator element 666 can be permanently affixed to the plate 664.

The plate 664 can freely move up and down within the cavity 662, or float, along the floor surface during operation, thereby permitting the agitator element 666 to automatically adjust to the type of floor surface below the foot assembly 14, such as carpet, including different carpet pile heights, or bare floor. A biasing element 668 can bias the plate 664 downwardly toward the surface to be cleaned. As shown herein the biasing element 668 comprises multiple springs between the bottom of the cavity 662 and the top of the plate 664. The biasing element 668 can be affixed to the plate 664, such that the plate 664, biasing element 668 and agitator element 666 can be removed from the cavity 662 as a sub-assembly.

A mounting assembly pivotally mounts the support frame 658 to the foot assembly 14. The mounting assembly can comprise a pair of spaced bearing brackets 670 formed in the base housing 406. A pivot pin 672 couples each support arm 660 to the corresponding bearing bracket 670. A torsion spring 674 can be mounted around each pivot pin 672 with the free ends being compressed between the support arm 660 and base housing 406 such that the torsion spring 674 is configured to bias the support frame 660 upwardly relative to the base housing 406 toward the non-use position shown in FIG. 28.

The foot assembly 14 can further comprise an actuator assembly for adjusting the position of the agitator assembly 422 with respect to the surface to be cleaned F. The actuator assembly comprises a latch 676 and a spring 678 for biasing the latch 676 toward a latched position. The latch 676 has a catch 680 at a lower portion thereof for engaging the support arm 660, a pivot shaft 682 for pivotally attaching the latch 676 to the foot 14, and an actuator in the form of a foot pedal 684 provided on the latch 676. A latch receiver 686 is provided in the base housing 406 for receiving the latch 676, with the foot pedal 684 extending vertically through an opening in the cover housing 408. The catch 680 engages a hook 688 on the bottom of each support arm 660. The spring 678 biases the latch 676 upwardly so the catch 680 is forced towards the hook 688.

The brackets 670 have upper and lower stops 690, 692 to provide a secure location for the support arms 660 to come to rest in the non-use and use positions. The stops 690, 692 prevent damage to the movable agitator assembly 422 and foot assembly 14 when moving between the use and non-use positions.

Figure 30:
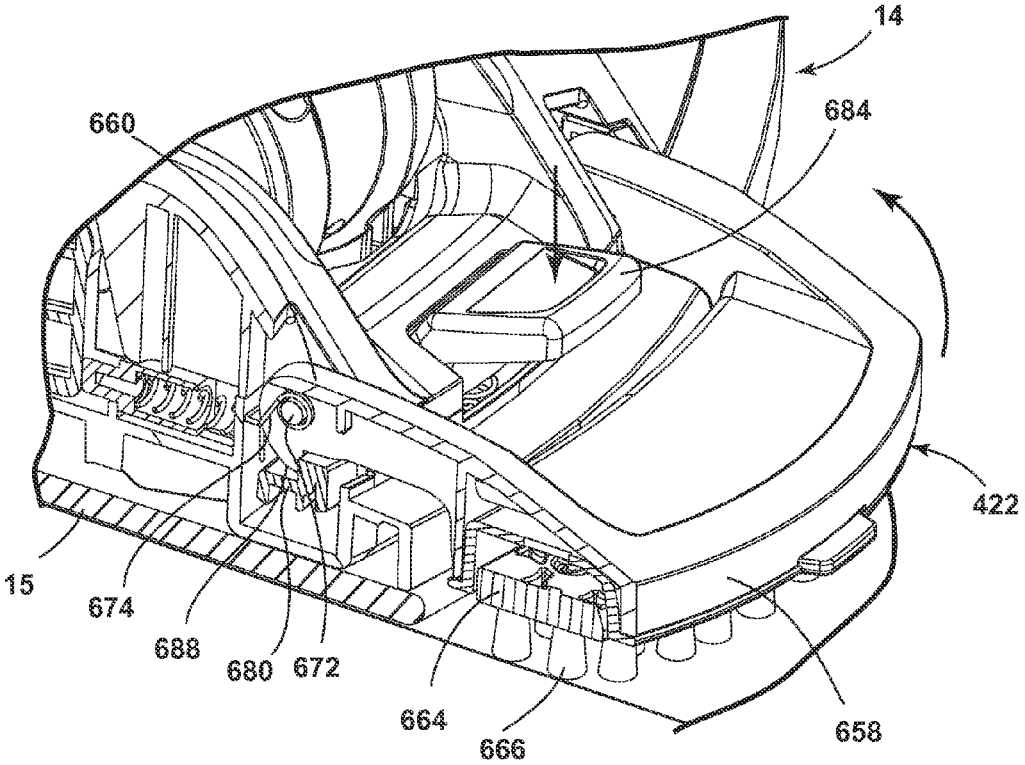
FIG. 30 is a partial cut-away view of the steam mop of FIG. 17 taken along line 30-30, with the agitator shown in a use position.

In the use position shown in FIG. 27, the agitator element 666 is positioned rearwardly of the base housing 406. A user can selectively pivot the agitator element 666 into the use position to clean heavily soiled areas on the surface to be cleaned. With the agitator element 666 in the use position, a user can make one or more reciprocal cleaning strokes to scrub the soiled area. To move the agitator element 666 from the use position to the non-use position shown in FIG. 28, the catch 680 can be disengaged from the hook 688 by depressing the foot pedal 684 on the upper portion of the latch 444, as indicated in FIG. 30, which pivots the latch 676 downwardly about an axis defined by the pivot shaft 682 relative to the surface to be cleaned and rotates the catch 680 away from the hook 688. The torsion springs 674 are then free to push the support arms 660 upwardly, thereby pivoting the support frame 658 and agitator element 666 upwardly to the non-use position, shown in FIG. 28, in which the agitator element 666 is spaced from the surface to be cleaned F.

A foot assembly 14 for a surface cleaning apparatus according to a fourth embodiment of the invention is shown in FIGS. 31-34. The foot assembly 14 can optionally be used in place of the foot assembly 14 of the third embodiment shown in FIG. 17. Because many of the components of this embodiment are similar to the third embodiments, like features are indicated with the same reference numerals. The foot assembly 14 differs from the third embodiment with respect to the movable agitator assembly 422; in this embodiment, steam can optionally be delivered via the agitator assembly 422 as well as through the aperture 350 in the base housing 406 to improve cleaning performance. One or more steam orifices 700 are provided on the agitator assembly 422 and can selectively receive steam from the steam generator 274 (FIG. 19). The steam orifices 700 can be formed in the plate 664 holding the agitator element 666. The cleaning pad 15 is not shown in FIG. 31 in order to clearly illustrate steam distribution from the aperture 350.

Figure 31:
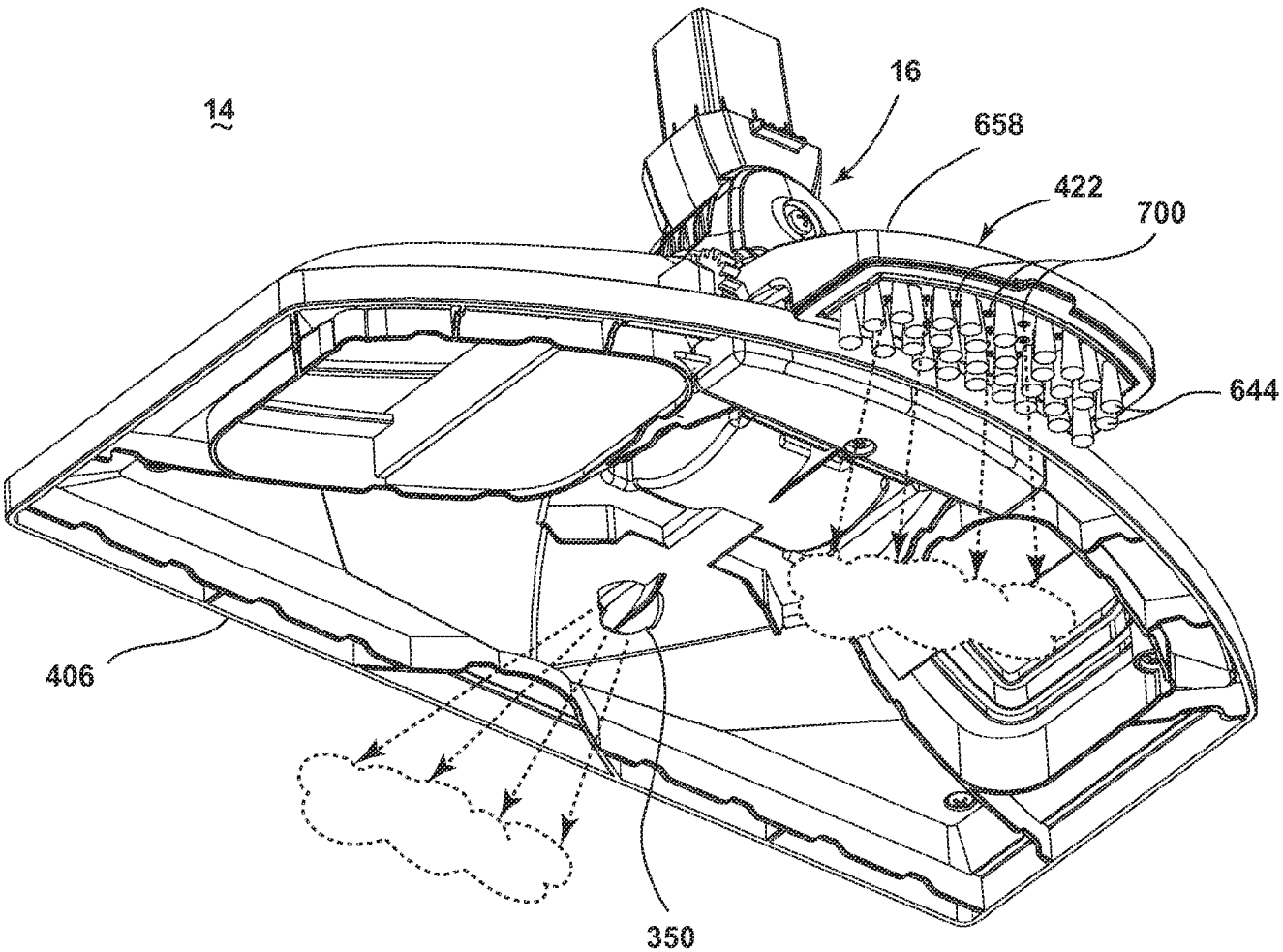
FIG. 31 is a bottom perspective view of a foot assembly according to a fourth embodiment of the invention.
Figure 32:
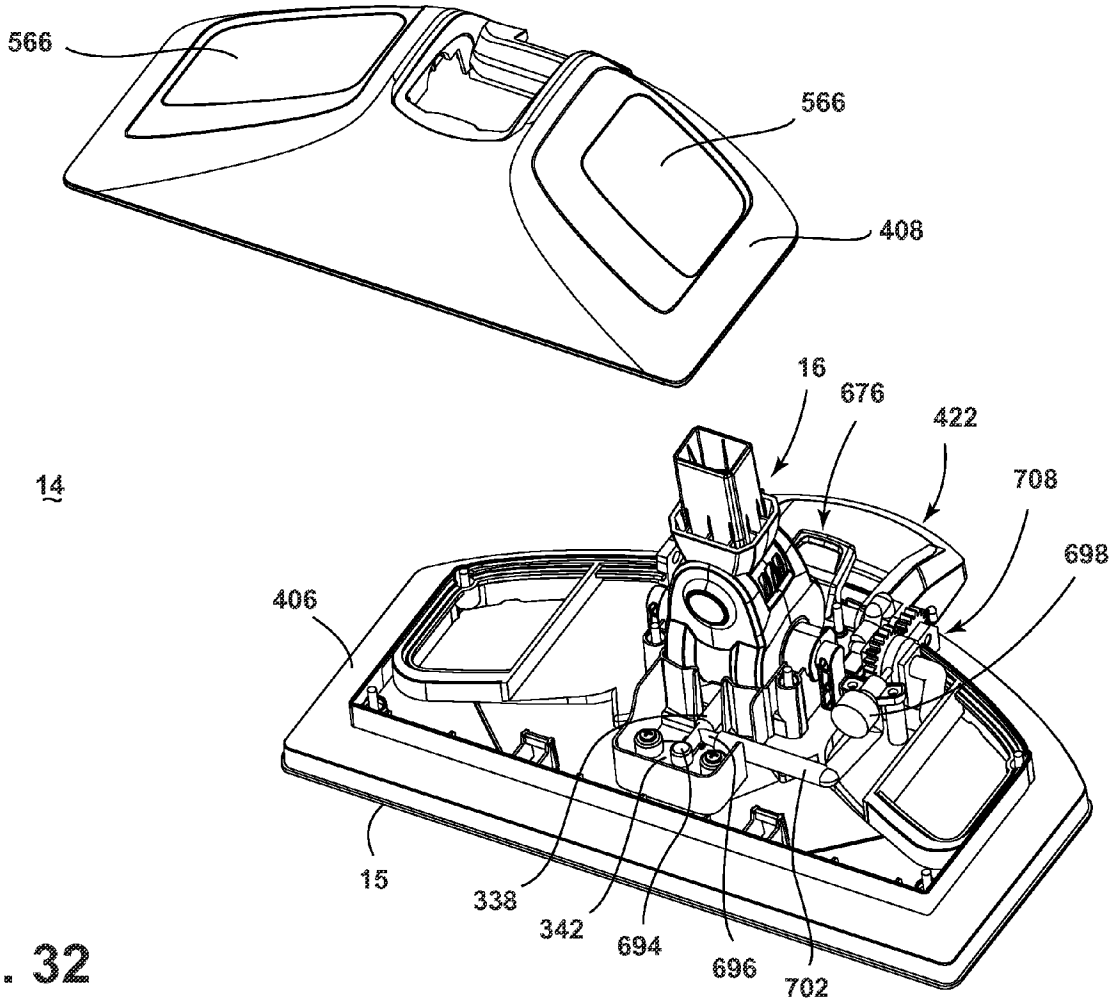
FIG. 32 is a partially exploded view of the foot assembly of FIG. 31.

FIG. 32 is a partially exploded view of the foot assembly 14 of FIG. 31. The steam distributor 342 is provided with a first outlet port 694 directed toward the cleaning pad 15 and a second outlet port 696 in fluid communication with one or more steam orifices 700 on the agitator assembly 422, as shown in FIG. 32.

Figure 33:
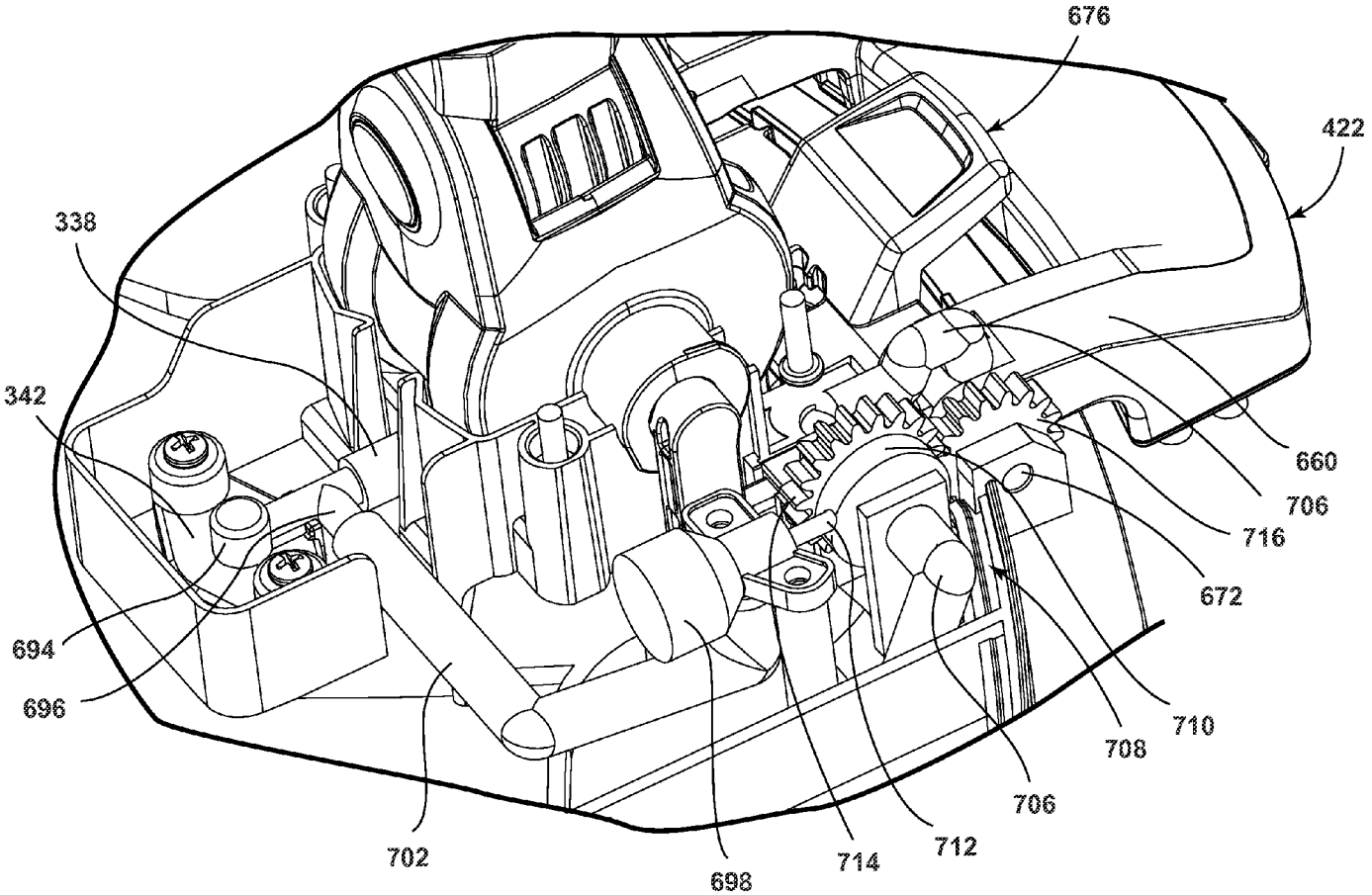
FIG. 33 is a close-up view of a steam delivery pathway for the foot assembly of FIG. 31, illustrating an agitator assembly in a use position.
Figure 34:
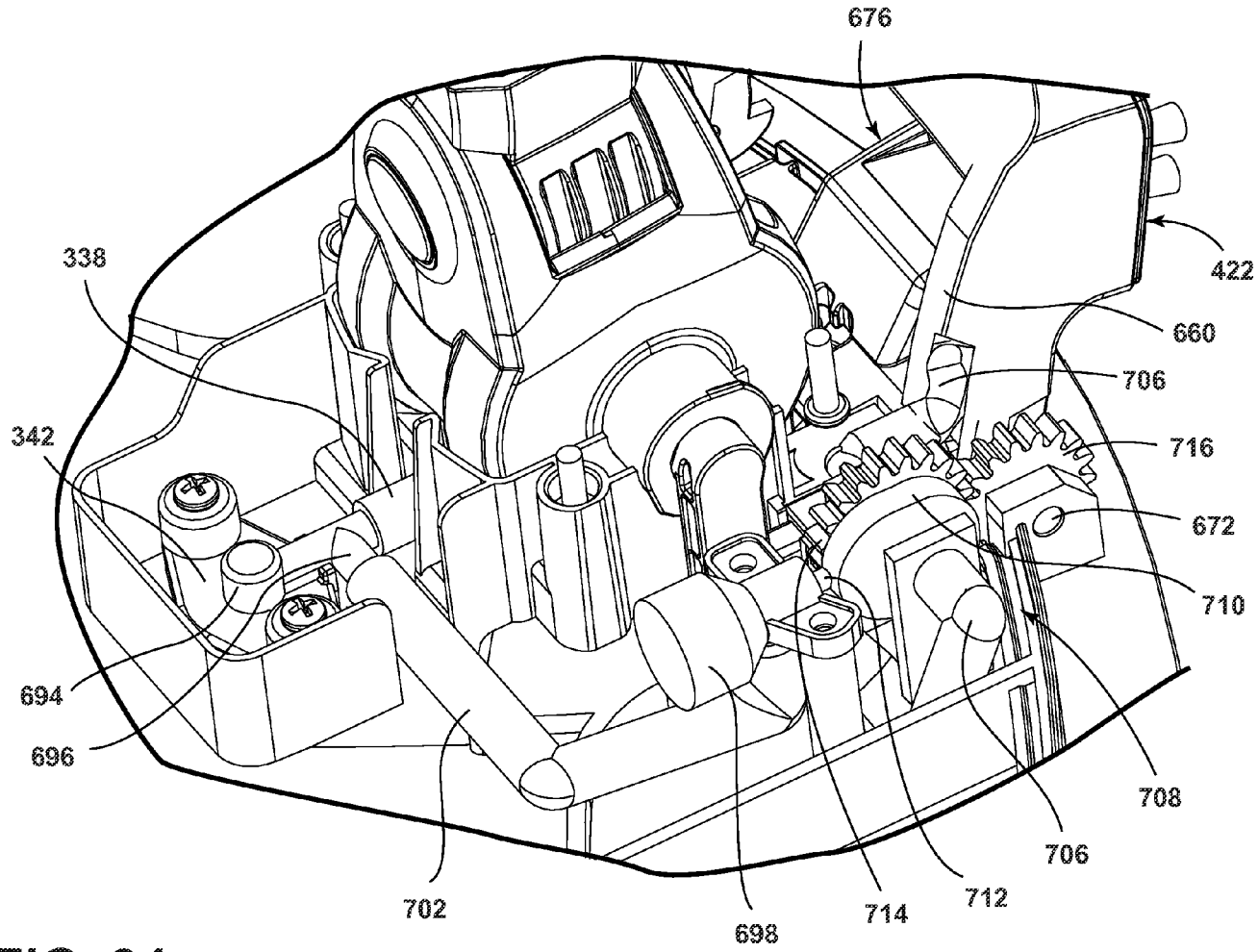
FIG. 34 is a close-up view similar to FIG. 33, illustrating the agitator assembly in a non-use position.

FIG. 33 is a close-up view of a steam delivery pathway for the foot assembly 14 of FIG. 31, illustrating the agitator assembly 422 in a use position. A valve 698 optionally controls the delivery of steam to the agitator assembly 422 and is integrated with the actuator assembly such that the valve 698 is open to deliver steam to the agitator assembly 422 when the agitator assembly 422 is in the use position as shown in FIG. 33, and the valve 698 is closed to shut off the delivery of steam when the agitator assembly 422 is in the non-use position, as shown in FIG. 34. The valve 698 has an inlet coupled with the second outlet port 696 via a first fluid conduit 702 and an outlet coupled with the agitator assembly 422 via a second fluid conduit 706.

A valve actuator 708 links the open or closed condition of the valve 698 with the movement of the agitator assembly 422 between the use and non-use positions, such that the valve 698 is open when the agitator assembly 422 is in the use position (FIG. 33) and closed when the agitator assembly 422 is in the non-use position (FIG. 34). One example of the valve actuator 708 illustrated in the figures comprises a cam 710 operably coupled with the actuator assembly and a cam follower 712 coupled with the valve 698.

The cam 710 can be operably coupled with the actuator assembly via a gear train as shown here or other suitable mechanical linkage such that as the agitator assembly 422 pivots between the use and non-use positions, the cam 710 will likewise rotate. The gear train shown herein comprises a first gear 714 coupled with the cam 710 and a second gear 716 coupled with the agitator assembly 422 and that is enmeshed with the first gear 714.

The first gear 714 coupled with the cam 710 can be coupled together in any suitable manner that will transmit rotation of the gear 714 to the cam 710. For example, the first gear 714 and cam 710 can be fixed to a common rotatable shaft (not shown), such that movement of the first gear 714 by the second gear 716 will rotate the shaft and cam 710.

The second fluid conduit 706 can extend through a hollow space in the first gear 714 and cam 710 such that the rotation of first gear 714 and the cam 710 will not disturb the fluid conduit 706. The second fluid conduit 706 can further extend through the support arms 660 of the agitator assembly 422 to fluidly communicate steam to the steam orifices 700 (FIG. 31).

The second gear 716 is fixed to the agitator assembly 422 for movement therewith, such that as the agitator assembly 422 pivots between the use and non-use positions, the second gear 716 will likewise rotate. As illustrated, the second gear 716 is mounted on one of the pivot pins 672 that pivotally couple the support arms 660 of the agitator assembly 422 to the base housing 406.

When the agitator assembly 422 is rotated between the use and non-use positions, the profile of the cam 710 is used to transform the rotational movement to linear movement of the cam follower 712 to open or close the valve 698. The cam 710 shown herein is configured to have a profile that will extend the cam follower 712 to open the valve 698 when the agitator assembly 422 is in the use position, as shown in FIG. 33, and that will depress the cam follower 712 to close the valve 698 when the agitator assembly 422 is in the non-use position, as shown in FIG. 34.

While the invention has been specifically described in connection with certain specific embodiments thereof, it is to be understood that this is by way of illustration and not of limitation, and the scope of the appended claims should be construed as broadly as the prior art will permit. For example, it will be apparent that the invention is not limited to steam mop floor cleaning machines of various configurations, but is equally applicable to, for example, extraction cleaning machines having fluid delivery and recovery tanks Representative examples of extraction cleaning machines are disclosed in U.S. Pat. Nos. 5,500,977 and 6,658,692, which are incorporated by reference herein in their entirety. In addition, although the invention has been described in connection with a steam mop, the invention is also equally applicable to wet mops having a fluid delivery tank as disclosed, for example, in U.S. Pat. No. 7,048,458, which is also incorporated by reference herein in its entirety. Moreover, the aforementioned actuator can be omitted and the agitator assembly can be manually movable between a non-use position and a use position as described above. Moreover, the movable agitator can be positioned exteriorly of the foot assembly 402 as disclosed herein, or it can be positioned inboard of the perimeter of the foot assembly 402.

What is claimed is:

1. A surface cleaning apparatus comprising:

a foot movable along a surface to be cleaned and comprising a base housing and cover housing attached to the base housing;

a handle coupled to the foot for maneuvering the foot along the surface to be cleaned;

a cleaning pad mounted to a lower surface of the foot and positioned to contact the surface to be cleaned; and a viewing window provided on the cover housing of the foot for viewing the cleaning pad;

wherein when the foot is moved along the surface to be cleaned a user may view the cleaning pad through the viewing window on the cover housing.

2. The surface cleaning apparatus of claim 1, wherein the viewing window comprises a cut-out in the cover housing.

3. The surface cleaning apparatus of claim 2, wherein the base housing comprises a light transmitting portion at least partially aligned with the cut-out.

4. The surface cleaning apparatus of claim 2, wherein the viewing window further comprises a light transmitting pane mounted to the foot and at least partially aligned with the cut-out.

5. The surface cleaning apparatus of claim 1, wherein the viewing window comprises one of a transparent material or a translucent material.

6. The surface cleaning apparatus of claim 1 and further comprising a second viewing window provided on an upper surface of the foot for viewing the cleaning pad.

7. The surface cleaning apparatus of claim 1 and further comprising an upright housing pivotally mounted to the foot wherein the handle is provided on the upright housing.

8. The surface cleaning apparatus of claim 7 and further comprising a universal joint coupling the foot and the upright housing.

9. The surface cleaning apparatus of claim 1 and further comprising:

a fluid source provided on one of the foot or the handle, and a fluid distributor provided on the foot and fluidly connected to the fluid source to distribute fluid onto the surface to be cleaned.

10. The surface cleaning apparatus of claim 9, wherein the foot comprises an interior chamber, with the fluid distributor provided in the interior chamber and the viewing window provided over the interior chamber, such that fluid is distributed past the viewing window.

11. The surface cleaning apparatus of claim 9, and further comprising a heating element mounted in one of the foot or the handle in fluid communication with the fluid distributor for providing heated fluid from the fluid distributor.

12. The surface cleaning apparatus of claim 11, wherein the heating element comprises a steam generator.

13. The surface cleaning apparatus of claim 9, wherein the fluid distributor is positioned above the cleaning pad for distributing fluid to the cleaning pad.

14. The surface cleaning apparatus of claim 1 and further comprising:

a fluid supply tank; and at least one of:

a light source, wherein light is transmitted from the light source to the fluid supply tank for illuminating the fluid supply tank;

a housing comprising a viewing window, wherein the fluid supply tank is mounted to the housing and the fluid supply tank can be viewed through the viewing window;

a second fluid supply tank comprising a viewing window, wherein the first and second fluid supply tanks are at least partially nested, such that a user can view the first fluid supply tank through the viewing window;

an upright housing pivotally coupled to the foot for movement about a first axis and a second axis by a coupling joint, and a detent mechanism for selectively preventing the coupling joint from rotating about the second axis when the surface cleaning apparatus is in a stored position; or a filter assembly, wherein the filter assembly is slidably mounted to the fluid supply tank.

15. A surface cleaning apparatus comprising:

a foot movable along a surface to be cleaned and comprising an interior chamber;

a handle coupled to the foot for maneuvering the foot along the surface to be cleaned;

a fluid source provided on one of the foot or the handle;

a cleaning pad mounted to a lower surface of the foot and positioned to contact the surface to be cleaned; and a viewing window provided on an upper surface of the foot over the interior chamber for viewing the cleaning pad;

a fluid distributor fluidly connected to the fluid source to distribute fluid onto the surface to be cleaned and provided on the foot in the interior chamber to distribute fluid past the viewing window;

wherein when the foot is moved along the surface to be cleaned a user may view the cleaning pad and the fluid distributed by the fluid distributor through the viewing window.

16. The surface cleaning apparatus of claim 15, wherein the foot comprises a base housing and cover housing attached to the base housing, wherein the viewing window is provided on the cover housing.

17. The surface cleaning apparatus of claim 15 and further comprising a heating element mounted in one of the foot and the upright housing in fluid communication with the fluid distributor for providing heated fluid from the fluid distributor.

18. The surface cleaning apparatus of claim 17, wherein the heating element comprises a steam generator.

19. The surface cleaning apparatus of claim 15, wherein the fluid distributor is positioned above the cleaning pad for distributing fluid to the cleaning pad.

20. The surface cleaning apparatus of claim 15 and further comprising an upright housing pivotally mounted to the foot wherein the handle is provided on the upright housing.

* * * * *